US008123383B2

(12) United States Patent
Gordin et al.

(10) Patent No.: US 8,123,383 B2
(45) **Date of Patent: *Feb. 28, 2012**

(54) MODIFIED REFLECTOR SURFACE TO REDIRECT OFF-FIELD SIDE LIGHT ONTO FIELD

(75) Inventors: Myron Gordin, Oskaloosa, IA (US); Timothy J. Boyle, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/901,909

(22) Filed: Oct. 11, 2010

(65) Prior Publication Data

US 2011/0044054 A1 Feb. 24, 2011

Related U.S. Application Data

(63) Continuation of application No. 11/333,133, filed on Jan. 17, 2006, now Pat. No. 7,862,213.

(60) Provisional application No. 60/644,688, filed on Jan. 18, 2005, provisional application No. 60/644,639, filed on Jan. 18, 2005, provisional application No. 60/644,536, filed on Jan. 18, 2005, provisional application No. 60/644,747, filed on Jan. 18, 2005, provisional application No. 60/644,534, filed on Jan. 18, 2005, provisional application No. 60/644,720, filed on Jan. 18, 2005, provisional application No. 60/644,636, filed on Jan. 18, 2005, provisional application No. 60/644,517, filed on Jan. 18, 2005, provisional application No. 60/644,609, filed on Jan. 18, 2005, provisional application No. 60/644,516, filed on Jan. 18, 2005, provisional application No. 60/644,546, filed on Jan. 18, 2005, provisional application No. 60/644,547, filed on Jan. 18, 2005, provisional application No. 60/644,638, filed on Jan. 18, 2005, provisional application No. 60/644,537, filed on Jan. 18, 2005, provisional application No. 60/644,637, filed on Jan. 18, 2005, provisional application No. 60/644,719, filed on Jan. 18, 2005, provisional application No. 60/644,784, filed on Jan. 18, 2005, provisional application No. 60/644,687, filed on Jan. 18, 2008.

(51) Int. Cl.
*F21V 7/00* (2006.01)

(52) U.S. Cl. ..... 362/310; 362/346; 362/297; 362/247; 362/350; 362/263

(58) Field of Classification Search ..... 362/310, 362/346, 297, 247, 350, 263
See application file for complete search history.

(56) References Cited

U.S. PATENT DOCUMENTS 2,447,923 A 8/1948 Tuck (Continued)

FOREIGN PATENT DOCUMENTS

EP 1 172 839 A2 1/2002

OTHER PUBLICATIONS

PCT/US2006001521 Musco Corporation—International Search Report, published Jun. 7, 2006.

*Primary Examiner* — Diane Lee
*Assistant Examiner* — Jessica M Apenteng
(74) *Attorney, Agent, or Firm* — McKee, Voorhees & Sease, P.L.C.

(57) ABSTRACT

An apparatus and method for high intensity lighting includes, in one aspect, a reflector frame having a main portion generally following a surface of revolution of the type that produces a converging beam and a second portion following a surface of revolution of the type that produces a different shape beam. Placement of the second portion in the reflector frame allows shifting of parts of the light beam in desired directions.

22 Claims, 36 Drawing Sheets

U.S. PATENT DOCUMENTS

Figure 1A:
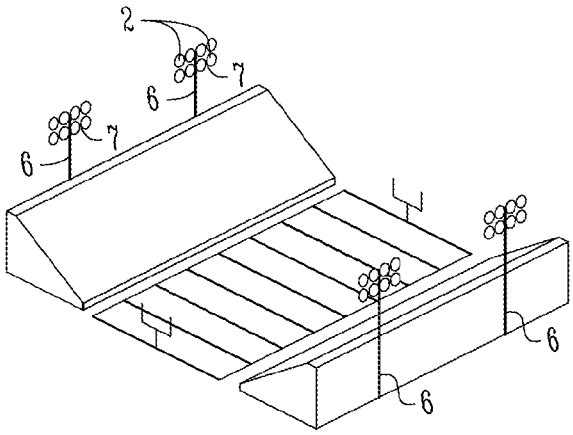
Fig. 1A (PRIOR ART)

| | | | |
|---|---|---|---|
| 4,208,704 | A | 6/1980 | Draper |
| 4,347,554 | A | 8/1982 | Matsushita |
| 4,816,974 | A | 3/1989 | Gordin |
| 4,947,303 | A | 8/1990 | Gordin et al. |
| 5,016,150 | A | 5/1991 | Gordin et al. |
| 5,161,883 | A | 11/1992 | Gordin et al. |
| 5,373,430 | A | 12/1994 | McDermott |
| 5,600,537 | A | 2/1997 | Gordin et al. |
| 5,816,691 | A | 10/1998 | Gordin et al. |
| 5,856,721 | A | 1/1999 | Gordin et al. |
| 6,036,338 | A | 3/2000 | Gordin |
| 6,203,176 | B1 | 3/2001 | Gordin |
| 7,178,958 | B2 | 2/2007 | Matsumoto et al. |

FRONT VIEW

RIGHT SIDE VIEW

BOTTOM VIEW

FRONT VIEW – DETAILED

BOTTOM VIEW – DETAILED

DETAIL B

SECTION A–A
ROTATED 55° CW

VIEW D–D
ROTATED 100° CCW

SECTION E–E

SECTION C–C
ROTATED 100° CCW

DETAIL F

DETAIL C
AS CAST

DETAIL P

DETAIL H
AS CAST

SECTION N-N
ROTATED 80° CCW

DETAIL M
AS CAST
ROTATED 90° CW

DETAIL M
AS MACHINED
ROTATED 90° CW

SECTION J–J

VIEW K–K

SECTION L-L
ROTATED 90° CCW

DETAIL L
AS CAST
ROTATED 90° CW

DETAIL L
AS MACHINED
ROTATED 90° CW

FRONT VIEW

RIGHT SIDE VIEW

BOTTOM VIEW

FRONT VIEW DETAILED

FRONT VIEW

RIGHT SIDE VIEW

BOTTOM VIEW

FRONT VIEW – DETAILED

FRONT VIEW

RIGHT SIDE VIEW

BOTTOM VIEW

FRONT VIEW – DETAILED

SECTION A–A
ROTATED 55° CW

FRONT VIEW

RIGHT SIDE VIEW

BOTTOM VIEW

FRONT VIEW

RIGHT SIDE VIEW

BOTTOM VIEW

FRONT VIEW

RIGHT SIDE VIEW

BOTTOM VIEW

FRONT VIEW – DETAILED

SECTION A-A
ROTATED 55° CW

FRONT VIEW

RIGHT SIDE VIEW

BOTTOM VIEW

FRONT VIEW

RIGHT SIDE VIEW

BOTTOM VIEW

FLAT PATTERN

FORMED VIEW

DETAIL A

FLAT PATTERN

FORMED VIEW

DETAIL A

FLAT PATTERN

FORMED VIEW

DETAIL A

FLAT PATTERN

FORMED VIEW

DETAIL A

FLAT PATTERN

FORMED VIEW

DETAIL A

FLAT PATTERN

FORMED VIEW

DETAIL A

FLAT PATTERN

FORMED VIEW

DETAIL A

FLAT PATTERN

FORMED VIEW

DETAIL A

FLAT PATTERN

FORMED VIEW

DETAIL A

MODIFIED REFLECTOR SURFACE TO REDIRECT OFF-FIELD SIDE LIGHT ONTO FIELD

CROSS REFERENCE TO RELATED APPLICATIONS

This is a continuation application of U.S. Ser. No. 11/333,133 filed Jan. 17, 2006, which claims priority under 35 U.S.C. §119 of a provisional application U.S. Ser. No. 60/644,688 filed Jan. 18, 2005, herein incorporated by reference in its entirety.

This application is also a non-provisional of the following provisional U.S. applications, all filed Jan. 18, 2005: U.S. Ser. No. 60/644,639; U.S. Ser. No. 60/644,536; U.S. Ser. No. 60/644,747; U.S. Ser. No. 60/644,534; U.S. Ser. No. 60/644,720; U.S. Ser. No. 60/644,636; U.S. Ser. No. 60/644,517; U.S. Ser. No. 60/644,609; U.S. Ser. No. 60/644,516; U.S. Ser. No. 60/644,546; U.S. Ser. No. 60/644,547; U.S. Ser. No. 60/644,638; U.S. Ser. No. 60/644,537; U.S. Ser. No. 60/644,637; U.S. Ser. No. 60/644,719; U.S. Ser. No. 60/644,784; U.S. Ser. No. 60/644,687, each of which is herein incorporated by reference in its entirety.

INCORPORATION BY REFERENCE

The contents of the following U.S. Patents are incorporated by reference by their entirety: U.S. Pat. Nos. 4,816,974; 4,947,303; 5,161,883; 5,600,537; 5,816,691; 5,856,721; 6,036,338.

I. BACKGROUND OF THE INVENTION

A. Field of the Invention

The present invention relates to lighting fixtures that produce high intensity, controlled, and concentrated light beams for use at relatively distant targets. One primary example is illumination of a sports field.

B. Problems in the Art

Figure 1B:
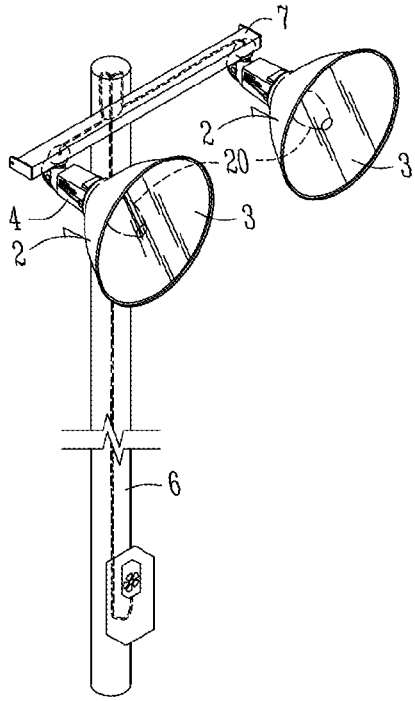
Fig. 1B (PRIOR ART)
Figure 1C:
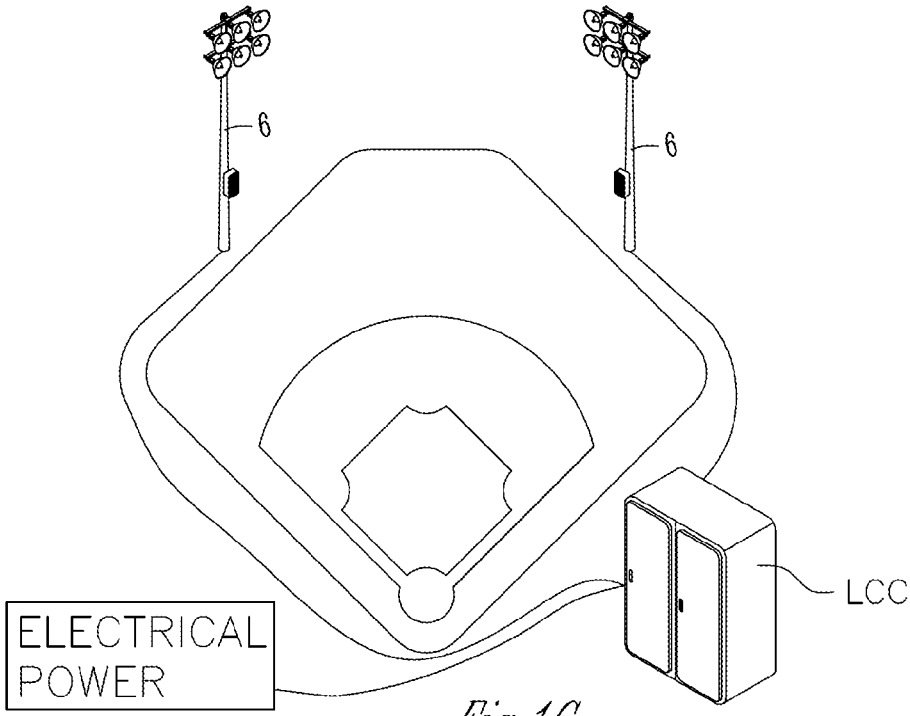
Fig. 1C (PRIOR ART)
Figure 1D:
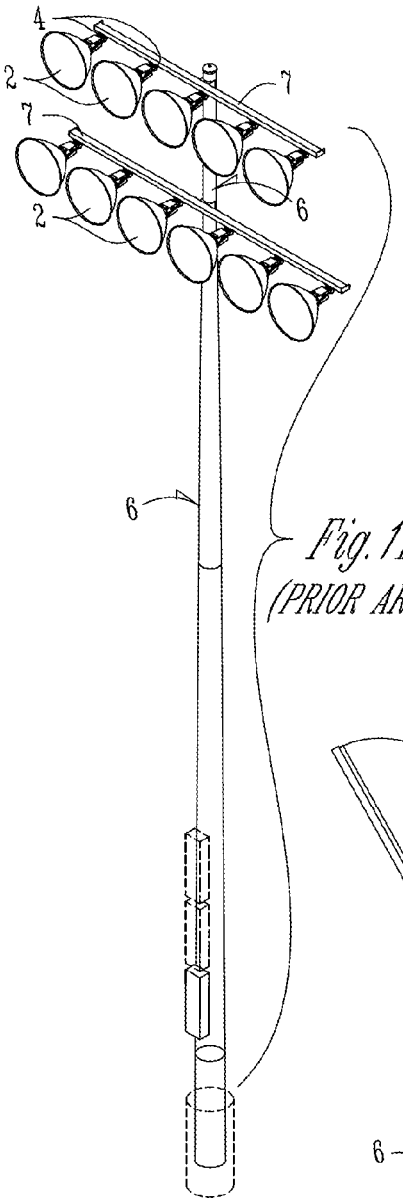
Fig. 1D (PRIOR ART)
Figure 1G:
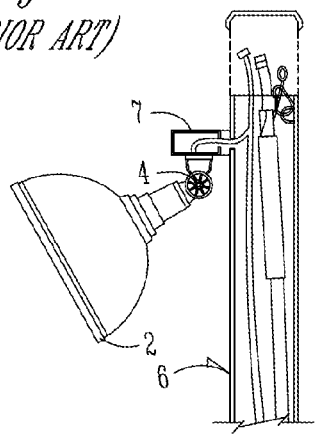
Fig. 1G (PRIOR ART)
Figure 1E:
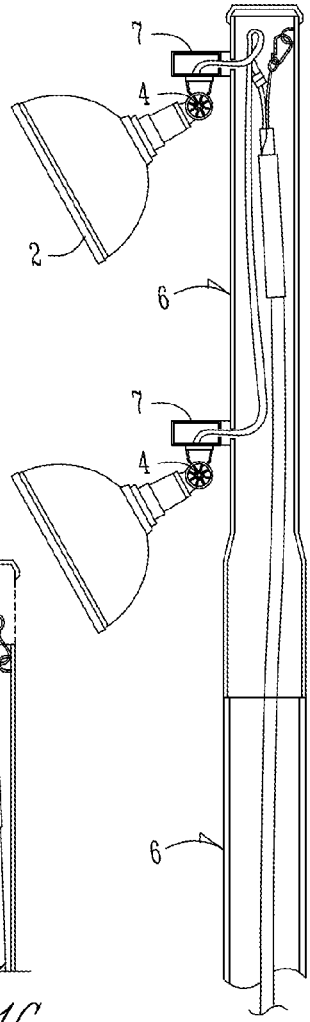
Fig. 1E (PRIOR ART)
Figure 1F:
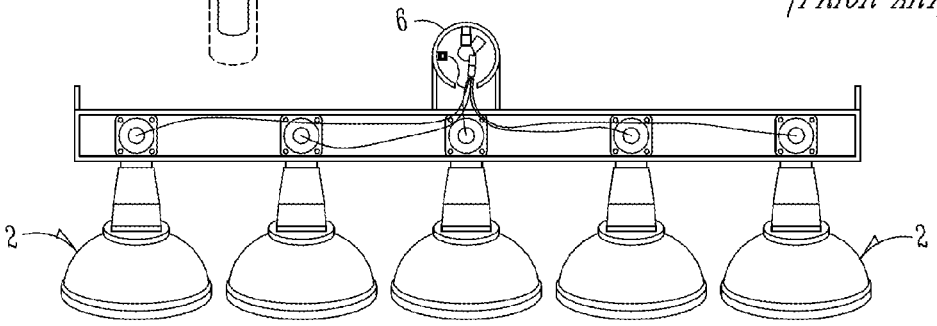
Fig. 1F (PRIOR ART)

The most conventional form of sports lighting fixture 2 is a several feet in diameter bowl-shaped aluminum reflector with a transparent glass lens 3 suspended from a cross arm 7 fixed to a pole 6 by an adjustable knuckle 4 (see FIG. 1B).

This general configuration of sports lighting fixtures 2 has remained relatively constant over many years because it is a relatively economical and durable design. It represents a reasonable compromise between the desire to economically control high intensity light to a distant target while at the same time minimizing wind load, which is a particularly significant issue when fixtures are elevated out-of-doors to sometimes well over 100 feet in the air. A much larger reflector could control light better. However, the wind load would be impractical. A significant amount of the cost of sports lighting systems involves how the lights are elevated. The more wind load, the more robust and thus more expensive, the poles must be. Also, conventional aluminum bowl-shaped reflectors are formed by a spinning process. Different light beam shapes are needed for different fixtures 2 on poles 6 for different lighting applications. The spinning process for creating aluminum bowl-shaped reflectors is relatively efficient and economical, even for a variety of reflector shapes and light controlling effects. The resistance of aluminum to corrosion is highly beneficial, particularly for outdoors lighting.

In recent times, sports lighting has also had to deal with the issue of glare and spill light. For example, if light travels outside the area of the sports field, it can spill onto residential houses near the sports field.

II. SUMMARY OF THE INVENTION

It is therefore a principal object, feature, or advantage of the present invention to present a high intensity lighting fixture, its method of use, and its incorporation into a lighting system, which improves over or solves certain problems and deficiencies in the art.

Other objects, features, or advantages of the present invention include such a fixture, method, or system which can accomplish one or more of the following:

a) reduce energy use;

b) increase the amount of useable light at each fixture for a fixed amount of energy;

c) more effectively utilize the light produced at each fixture relative to a target area;

d) is robust and durable for most sports lighting or other typical applications for high intensity light fixtures of this type, whether outside or indoors.

A. Exemplary Aspects of the Invention

In one aspect of the invention, the spun aluminum reflector is replaced with a frame over which a high reflectivity reflecting surface can be placed. The relatively thin but high reflectivity surface can be mounted to the interior of the frame and shielded from the elements. Such a frame is economical, is robust, and can be mass produced economically. It also can be made with substantial precision so that they are consistent from one to the other. Also, by applying the reflecting surface separately to the frame, instead of having the reflecting surface and support the same thing (e.g. the spun aluminum reflector), different beam shapes and characteristics can be created by interchanging reflecting surfaces, rather than making different spun aluminum reflectors.

In another aspect of the invention, at least a part of the main reflecting portion has a shape and orientation different from the portion which follows a surface of revolution. One example is an angular section below the lamp that diverges light more than the portion which follows the surface of revolution. This can be effective to place light on the target that otherwise would reflect from the bottom of the reflecting surface and spill outward and upward outside the target in the direction the fixture is aimed. A second example is an angular section placed to one side or the other of the lamp that diverges light more than the portion that follows the surface of revolution. This can be effective to shift back onto the target area light that otherwise tends to spill outward outside the target area sideways in an opposite direction from that side of the fixture. If appropriately used, each less converging part of the main reflecting surface can add light otherwise lost from the target, and thus increase the amount of light to the target per energy unit used. This can also allows minimization of number of fixtures. It can also reduce glare and spill light. These and other objects, features, advantages and aspects of the present invention will become more apparent with reference to the accompanying specification and claims.

III. BRIEF DESCRIPTION OF THE DRAWINGS

FIGS. 1A-G are general diagrammatic views of a conventional sports lighting system and components.

Figure 2:
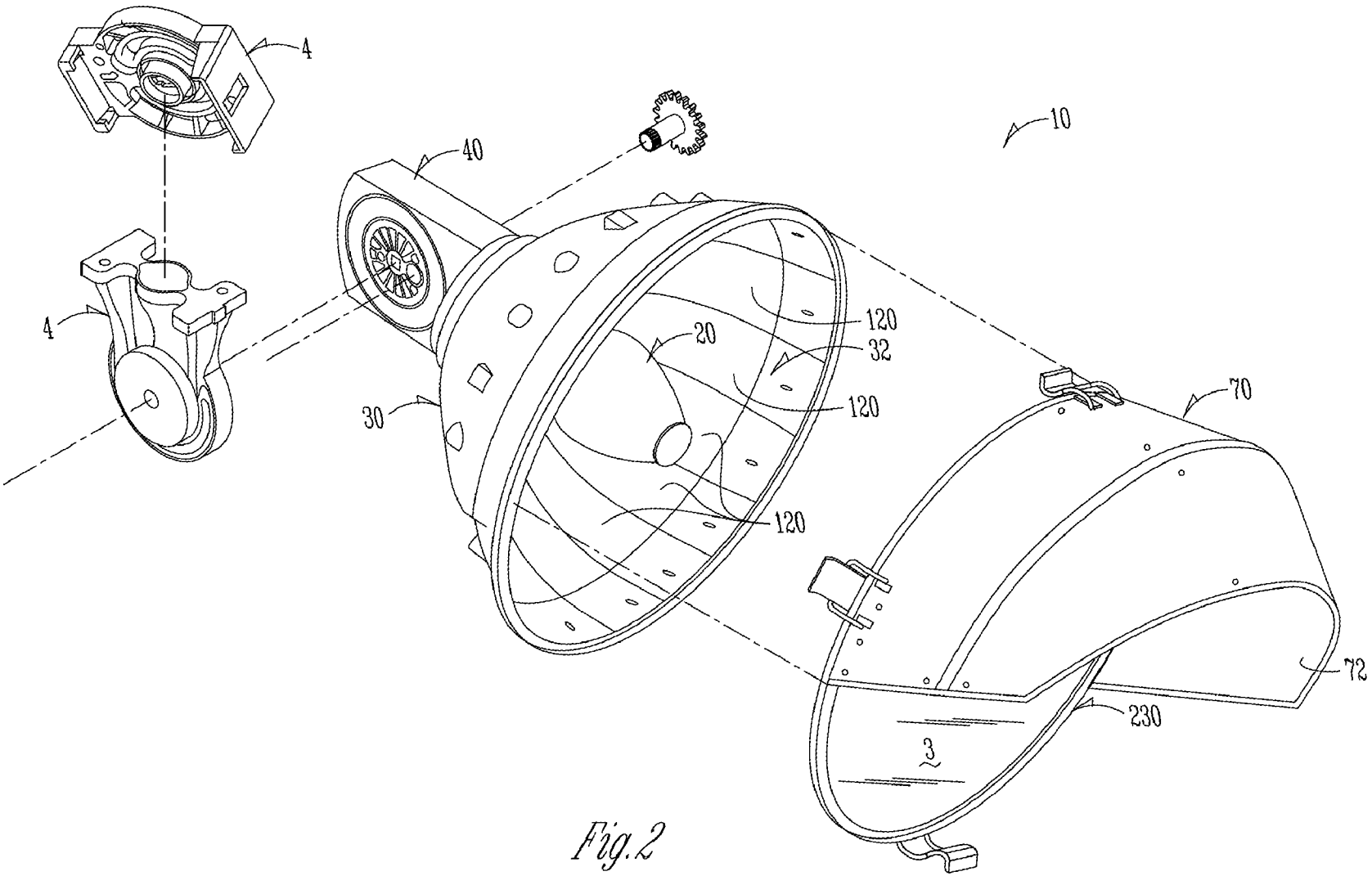

FIG. 2 is a partially exploded view of a light fixture according to an exemplary embodiment of the present invention.

Figure 3A:
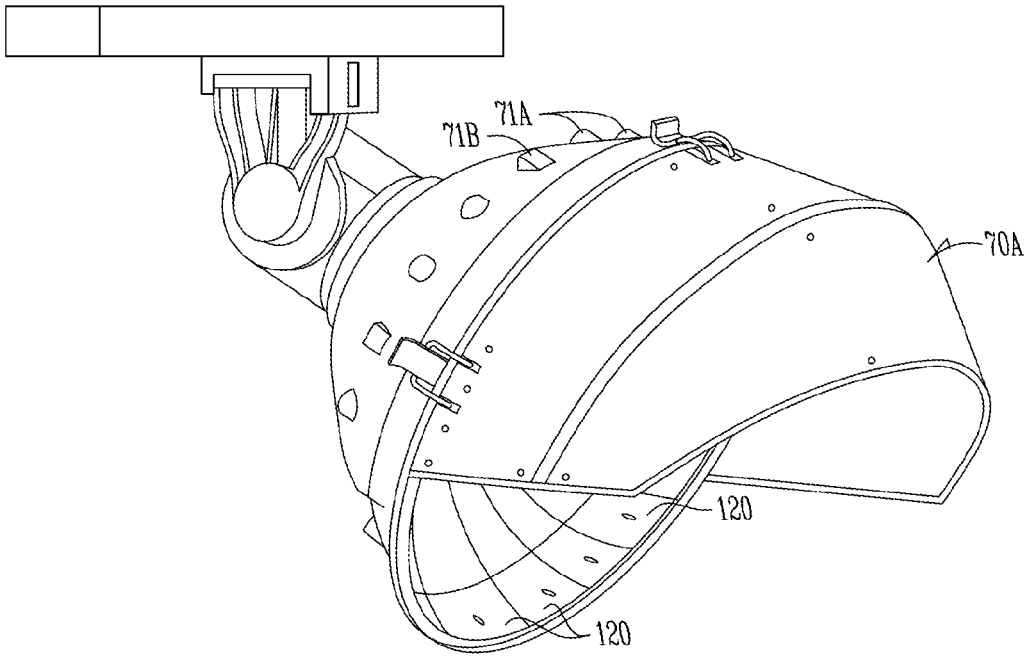
Figure 3B:
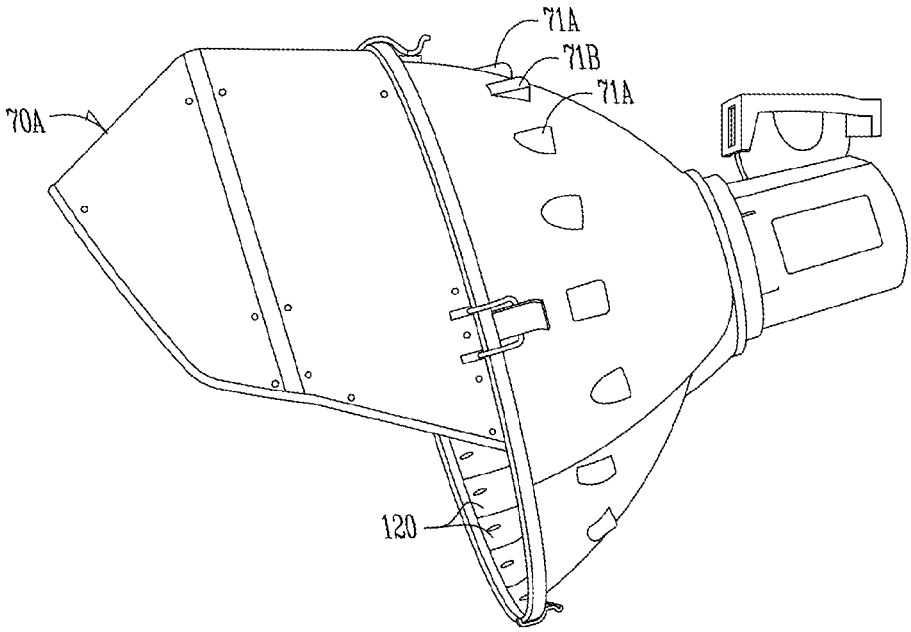

FIGS. 3A and B are assembled views of FIG. 2.

Figure 4A:
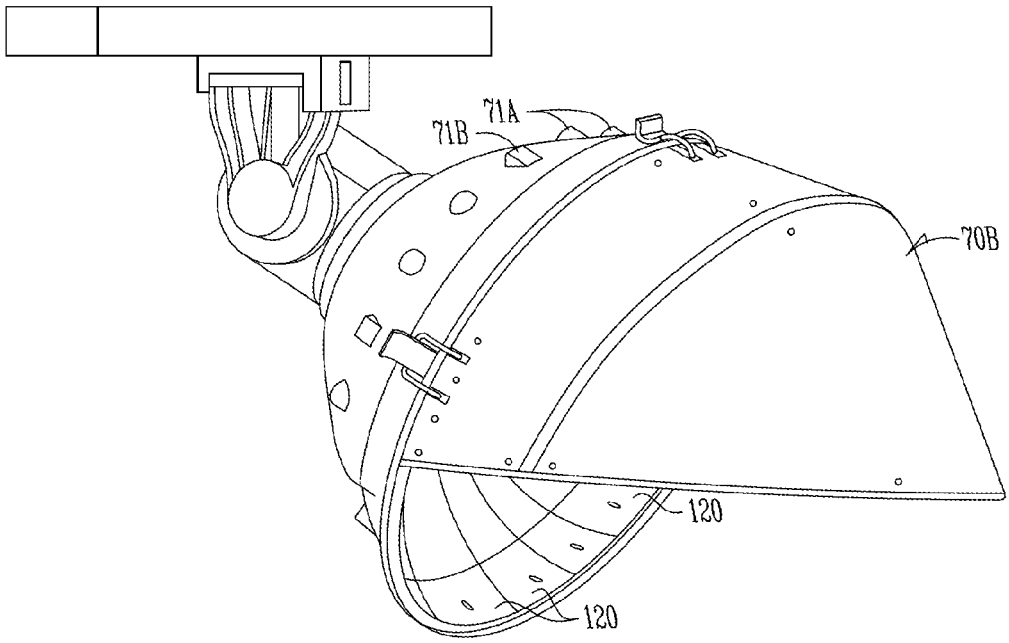
Figure 4B:
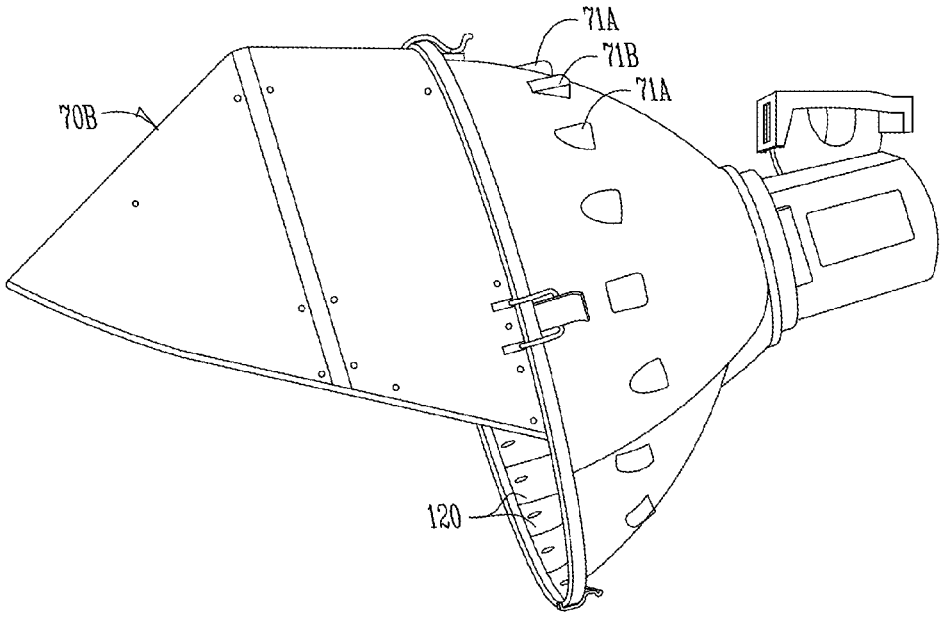

FIGS. 4A and B are assembled views of a slightly different embodiment according to the invention.

Figure 5A:
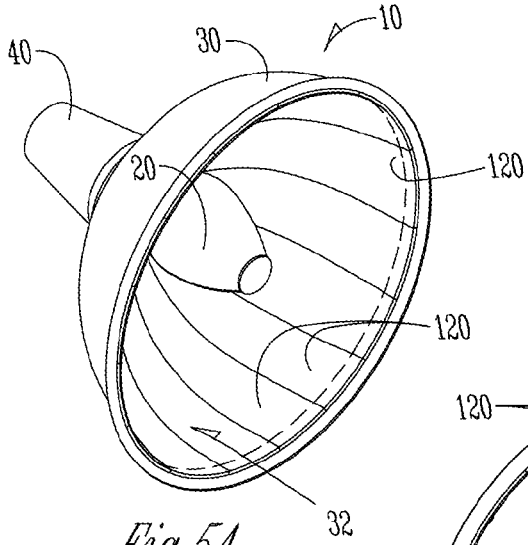
Figure 5C:
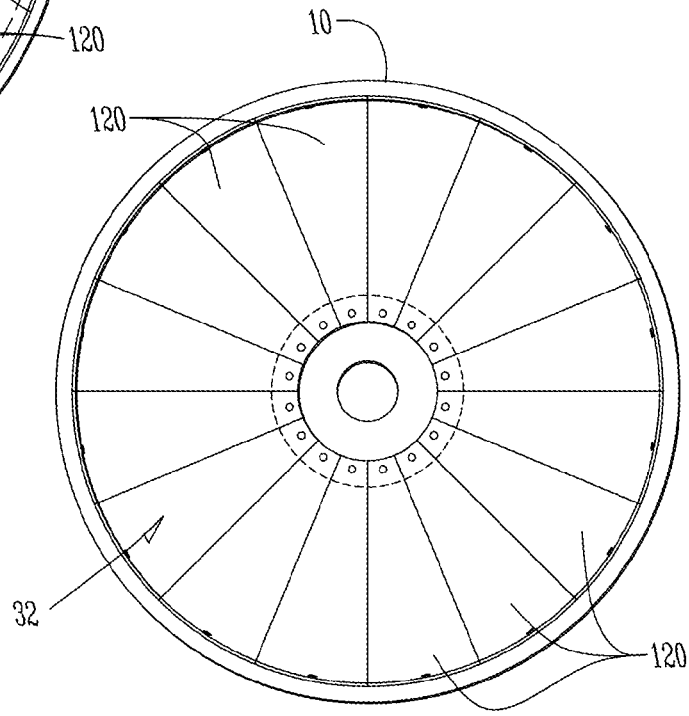
Figure 5B:
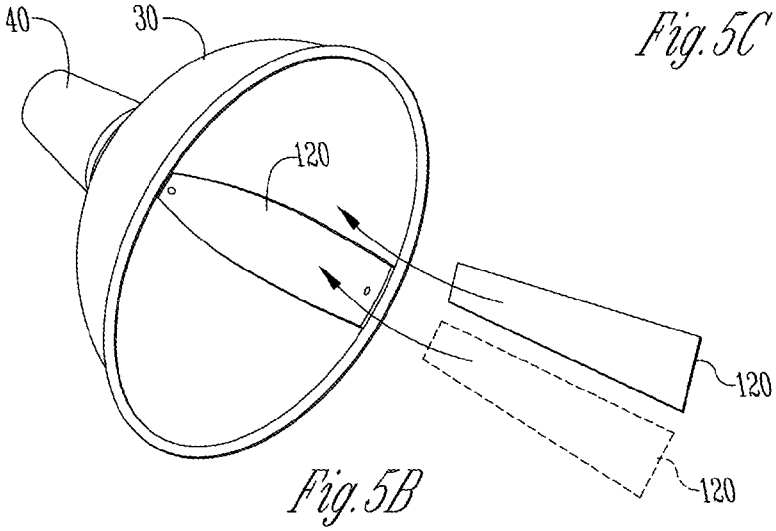

FIGS. 5A-C are various views diagrammatically illustrating reflective inserts that can be positioned inside a reflector frame.

Figure 6A:
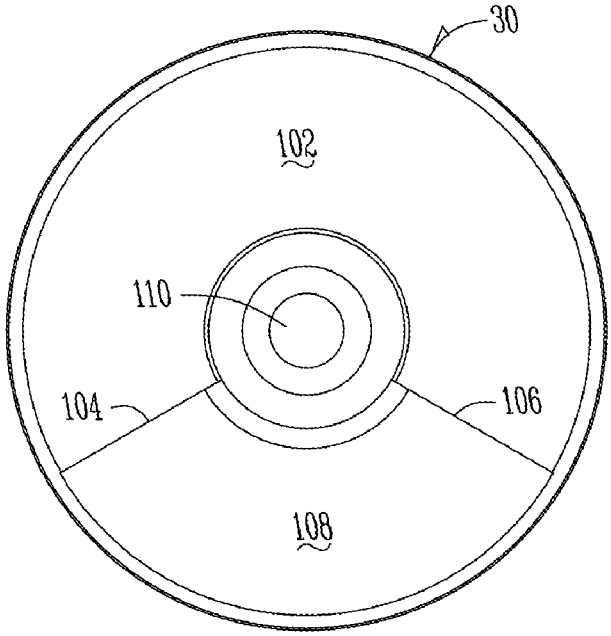
Figure 6C:
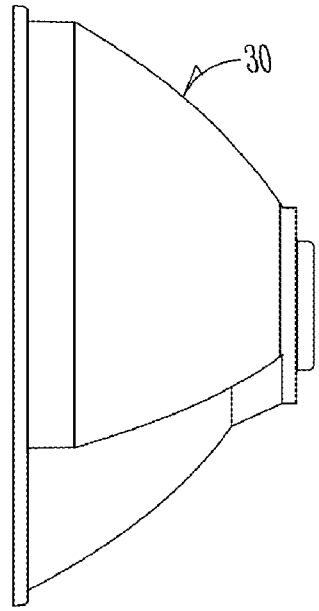
Figure 6B:
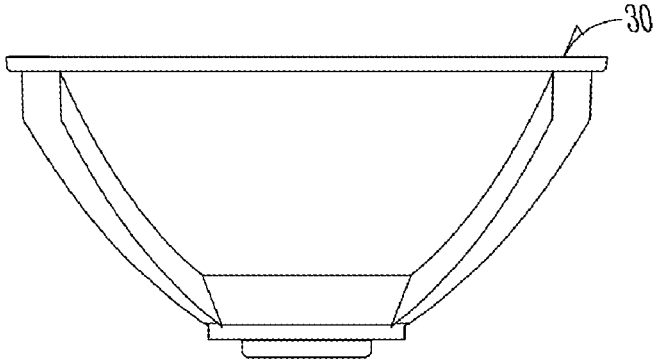
Figure 6D:
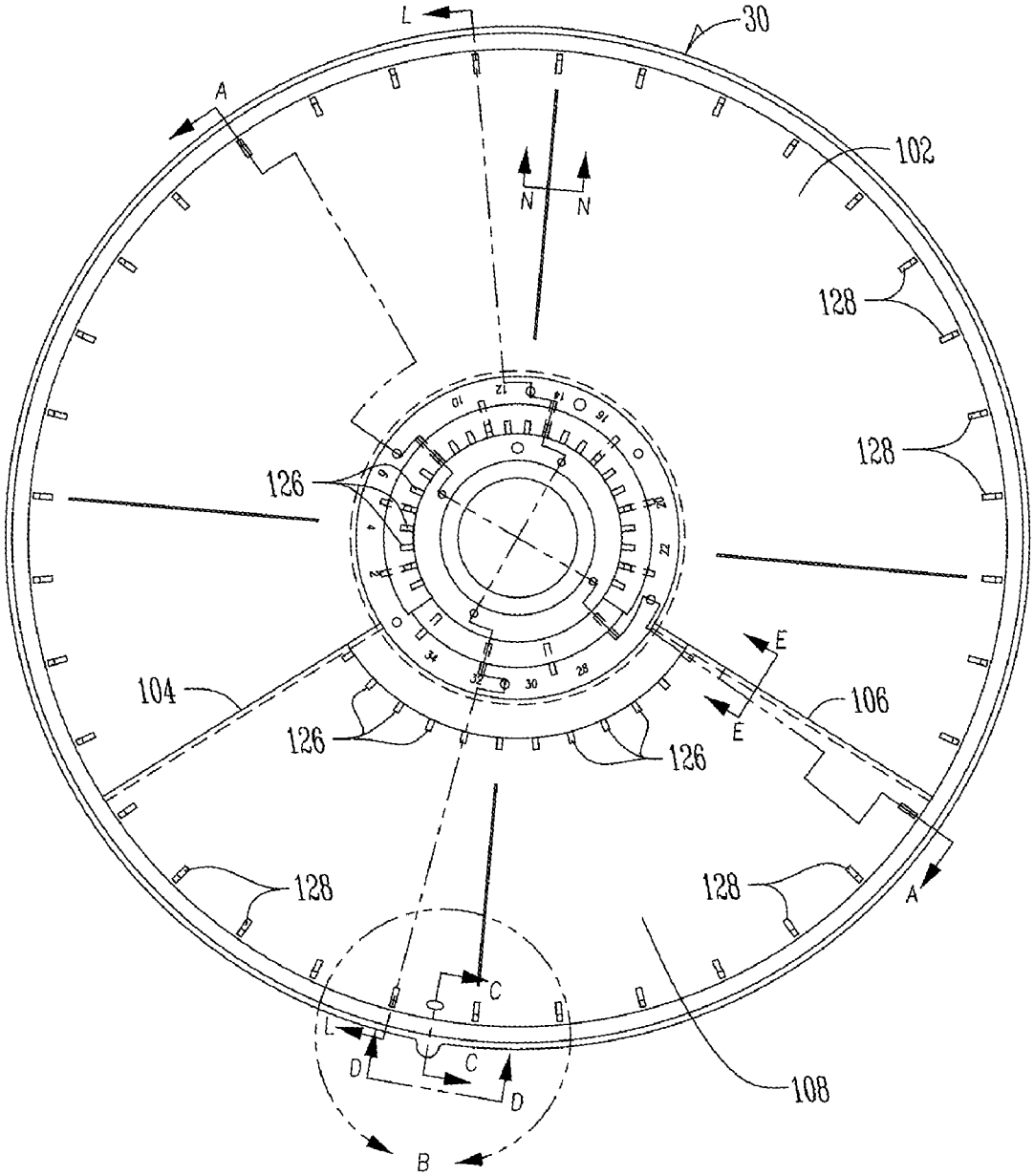
Figures 6E, 6G:
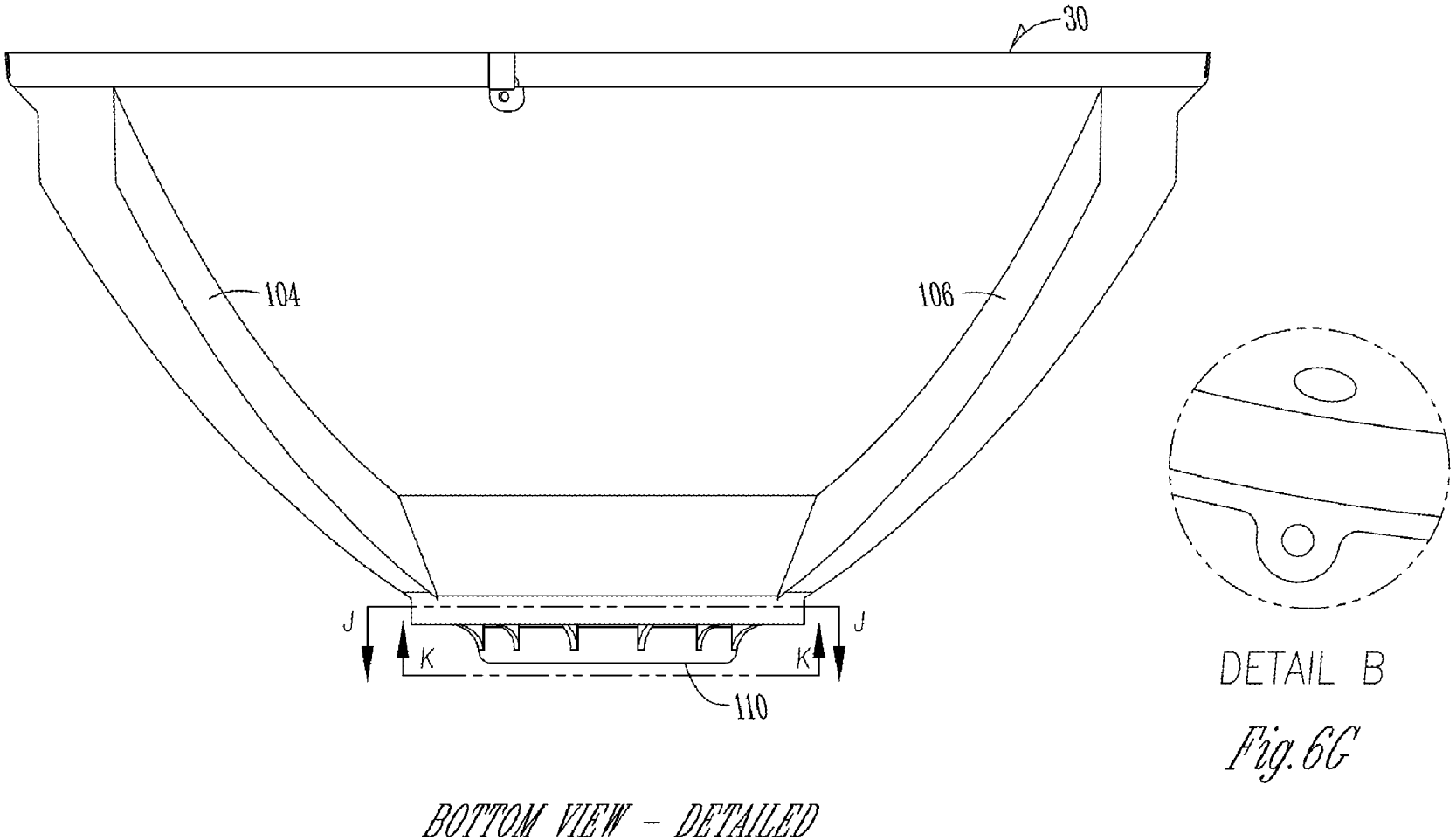
Figure 6F:
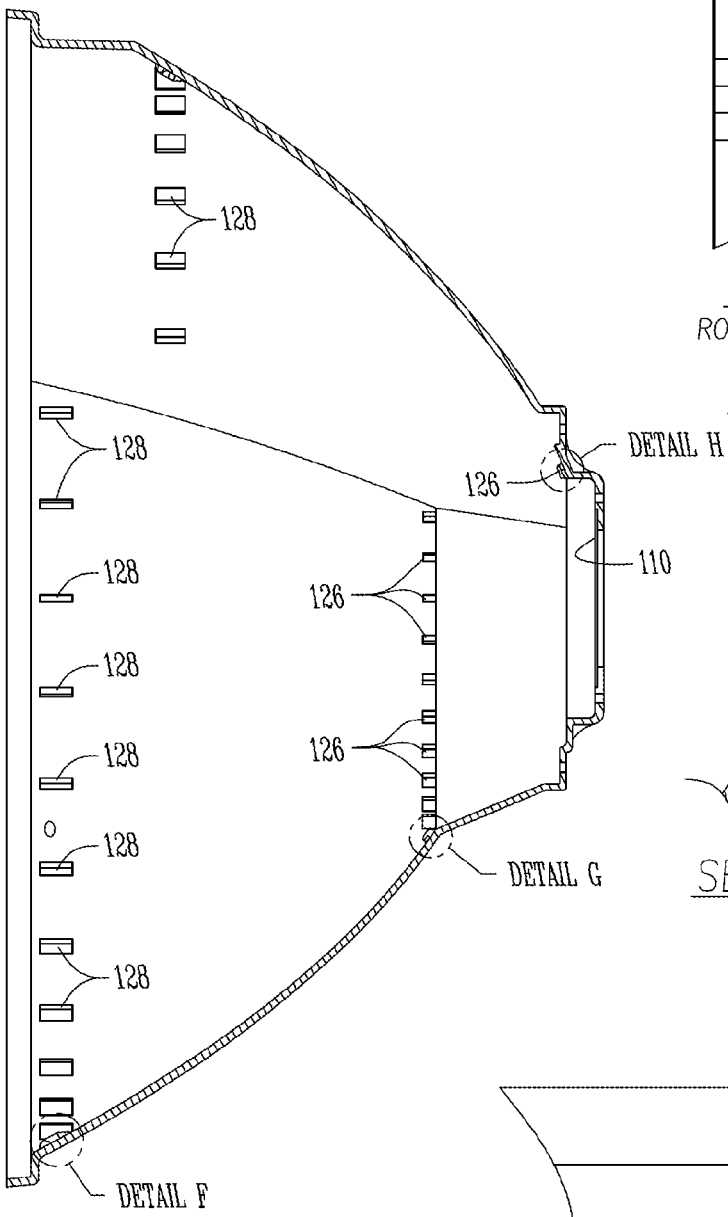
Figure 6I:
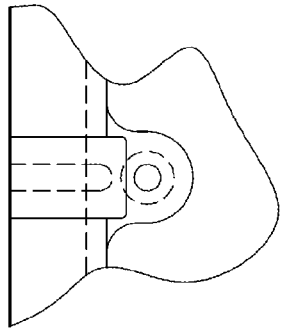
Figure 6J:
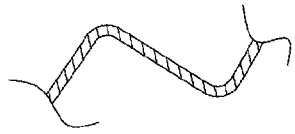
Figure 6H:
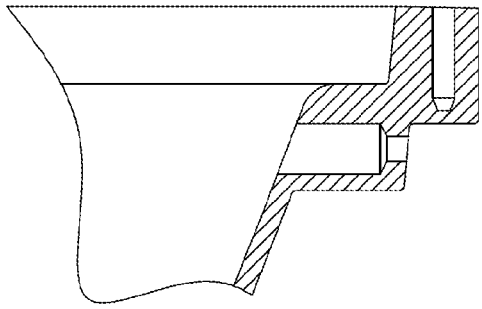
Figure 6K:
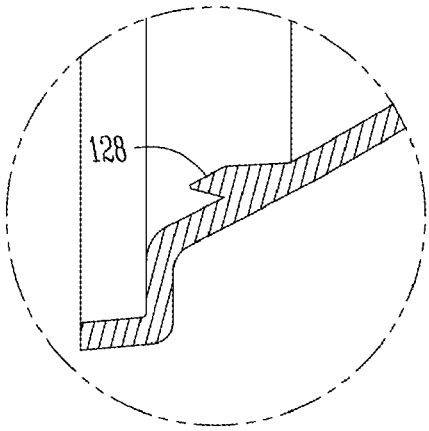
Figure 6L:
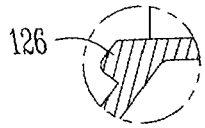
Figure 6M:
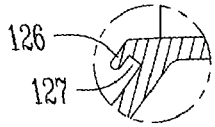
Figure 6N:
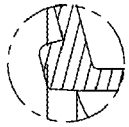
Figure 6R:
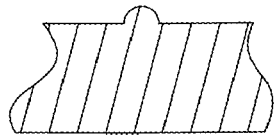
Figure 6S:
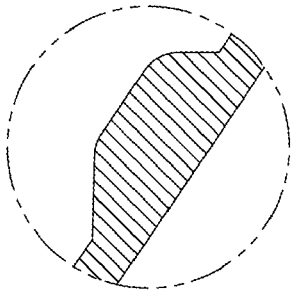
Figure 6T:
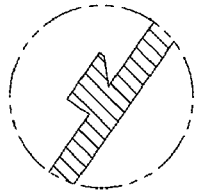
Figure 6O:
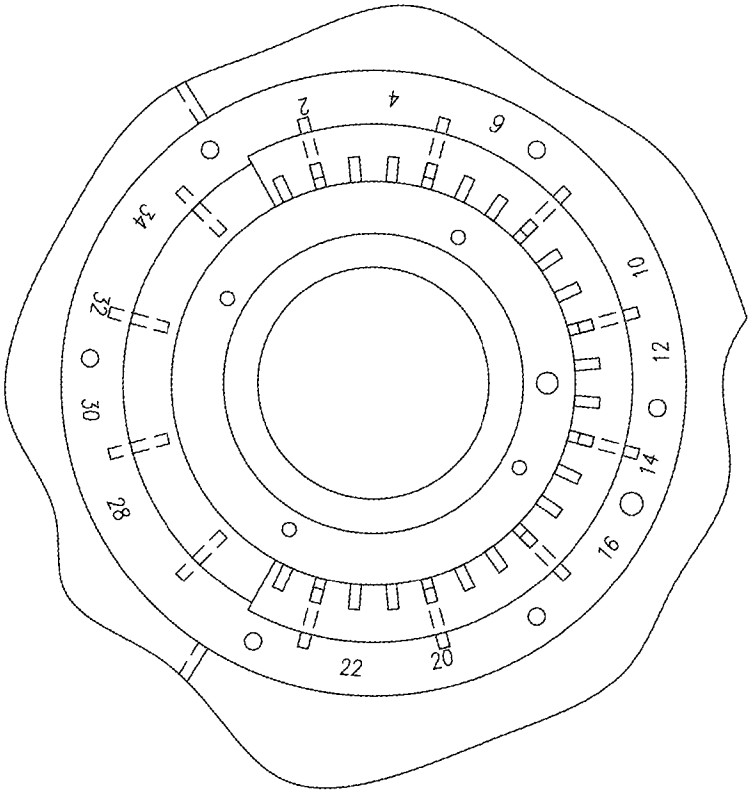
Figure 6P:
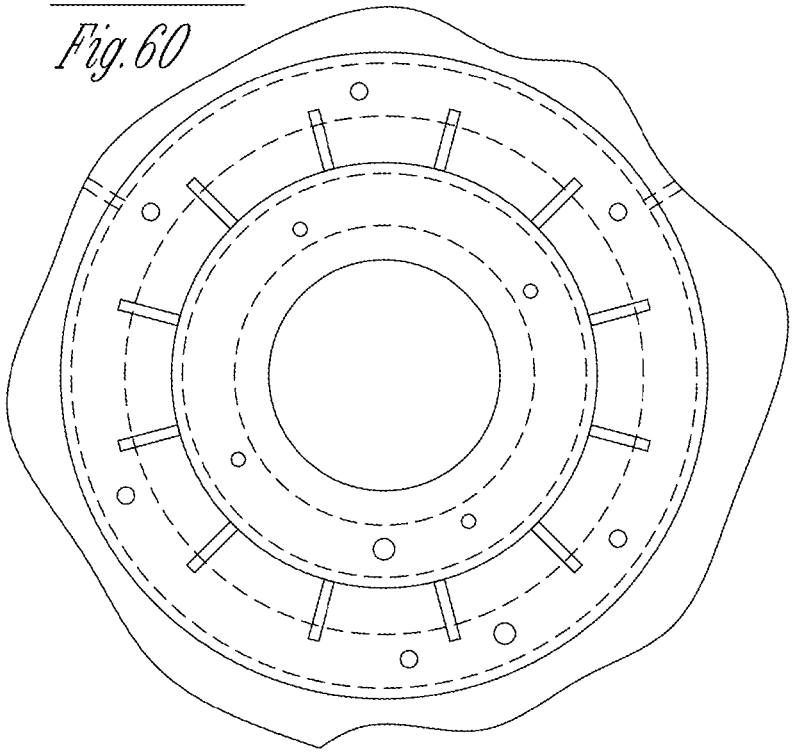
Figure 6Q:
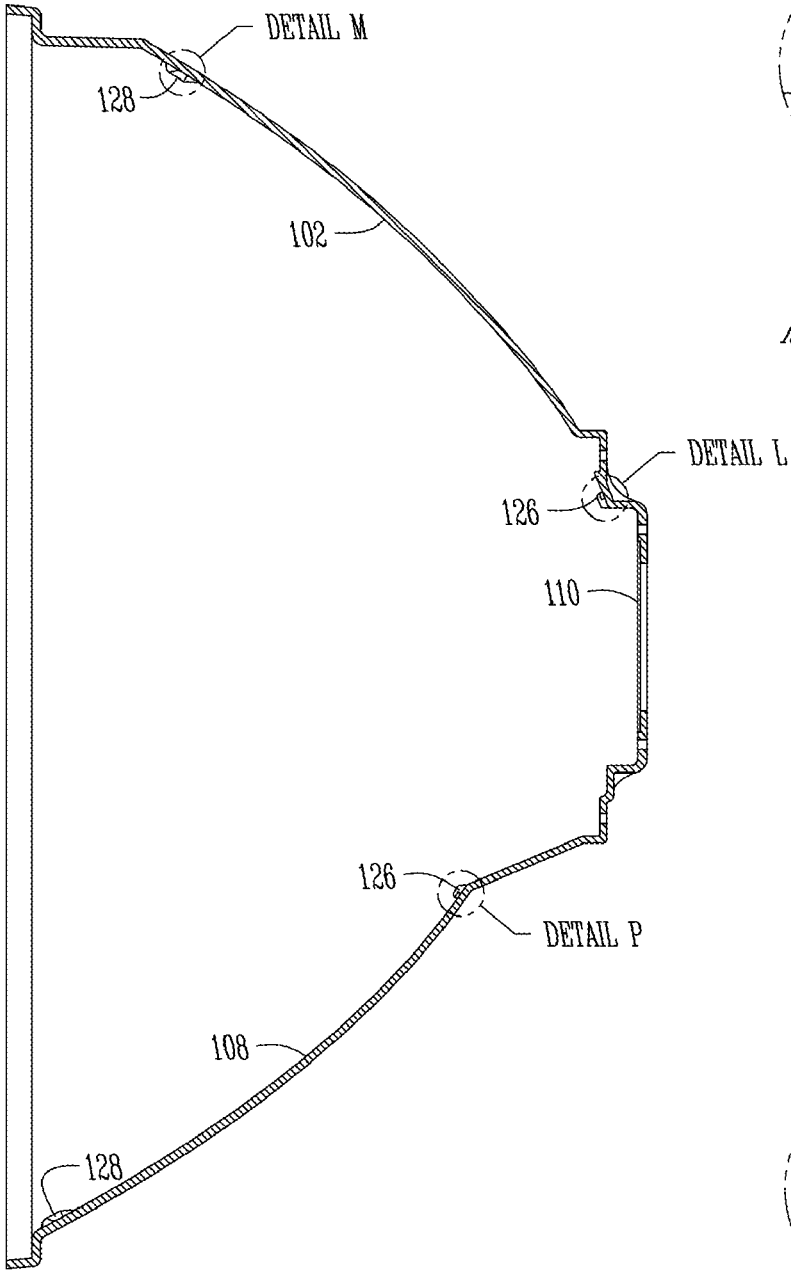
Figure 6U:
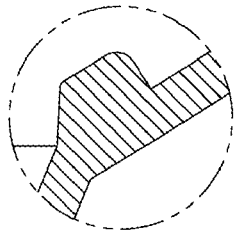
Figure 6V:
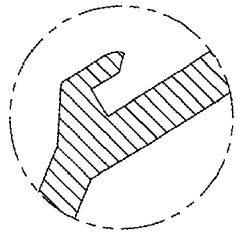

FIGS. 6A-V are various views of one embodiment of a reflector frame.

FIGS. 7A-D are various views of an alternative reflector frame.

FIGS. 8A-D are various views of an alternative reflector frame.

FIGS. 9A-E are various views of an alternative reflector frame.

Figure 10A:
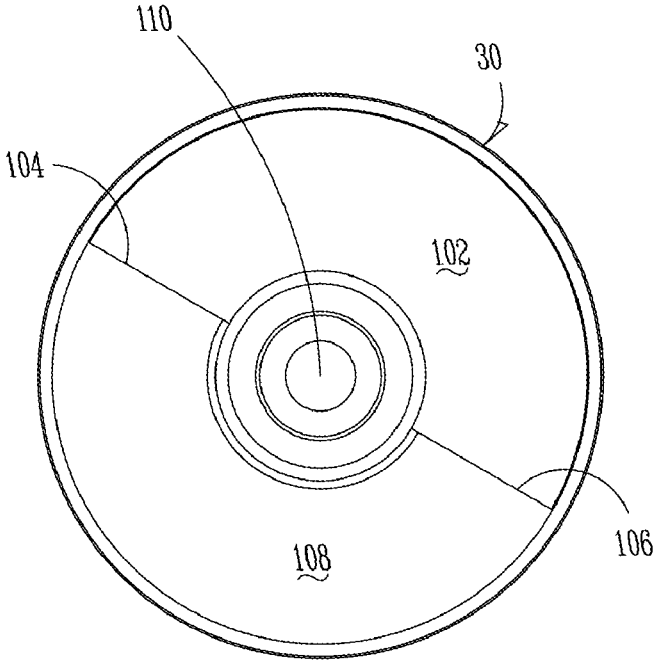
Figure 10C:
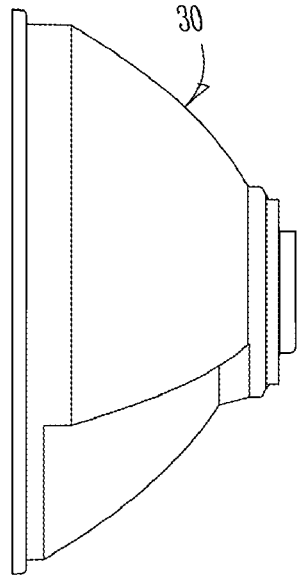
Figure 10B:
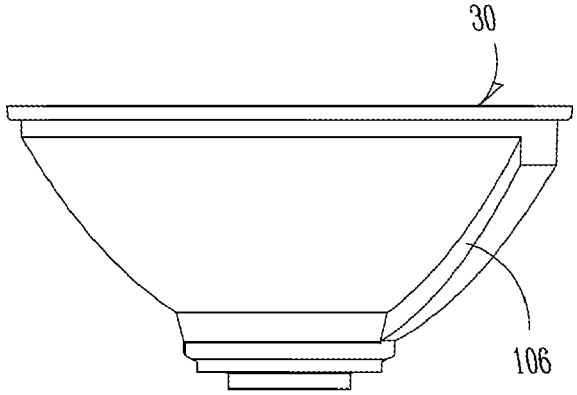

FIGS. 10A-C are various views of an alternative reflector frame.

Figure 11A:
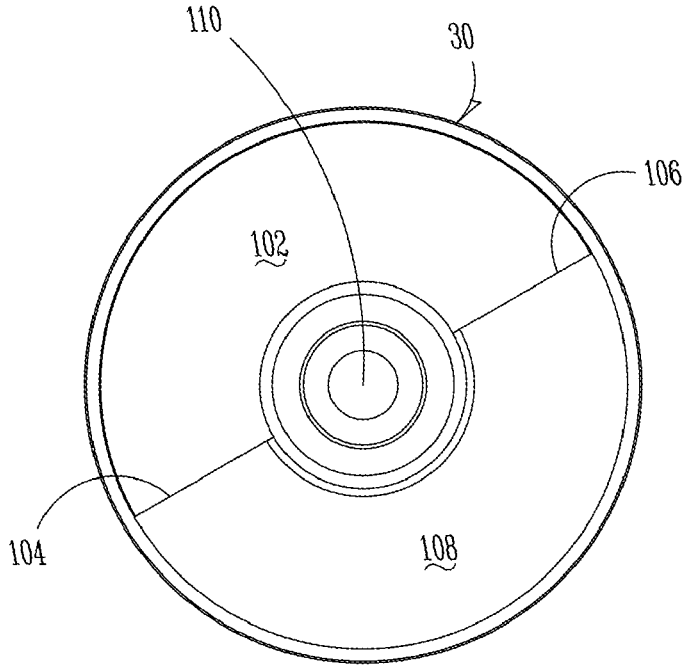
Figure 11C:
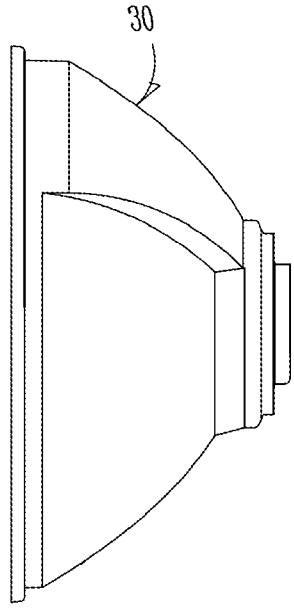
Figure 11B:
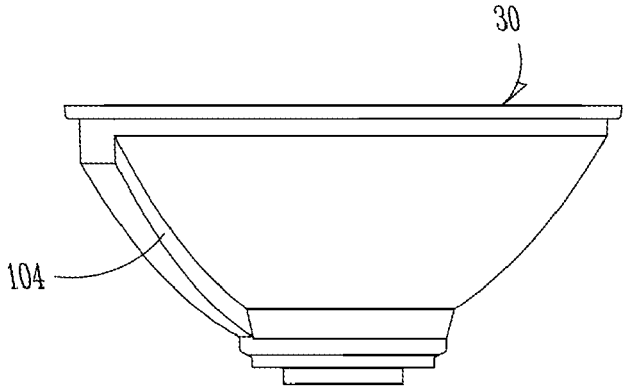
Figure 12A:
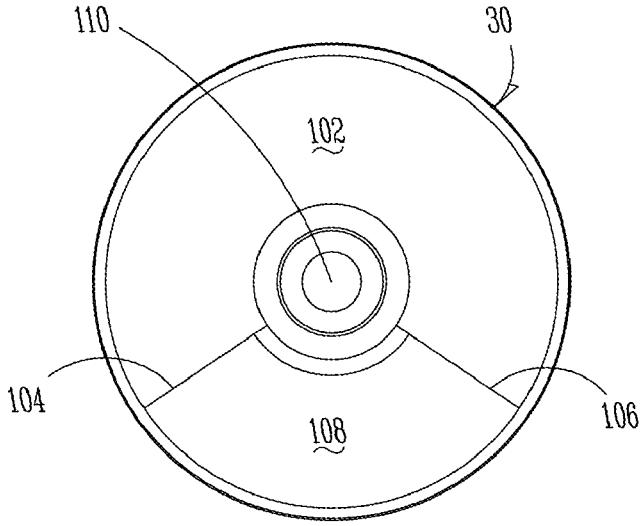
Figure 12C:
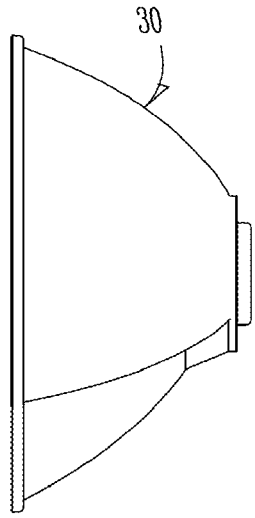
Figure 12B:
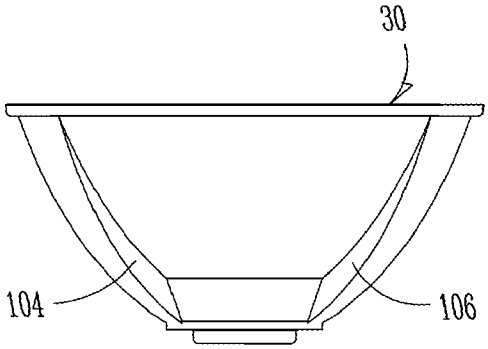
Figure 12D:
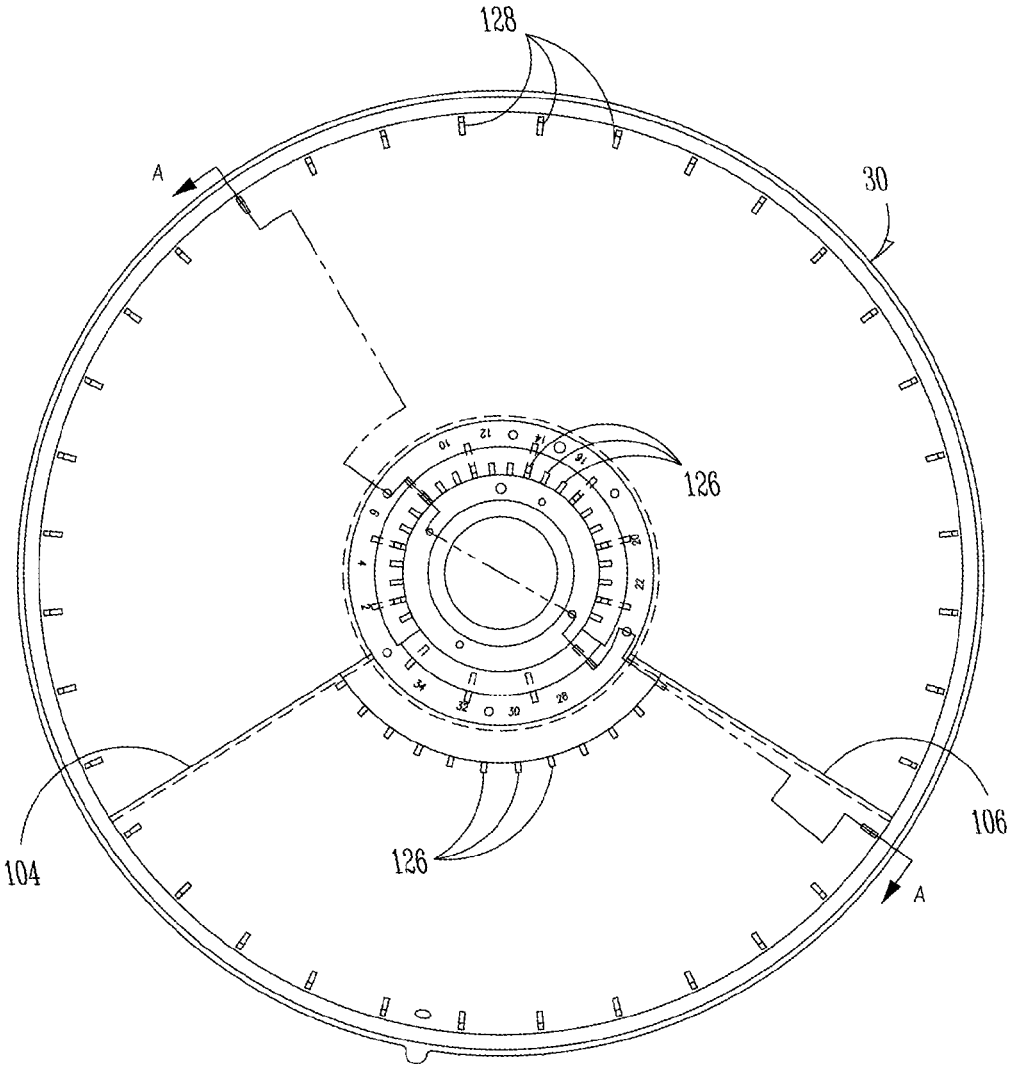
Figure 12E:
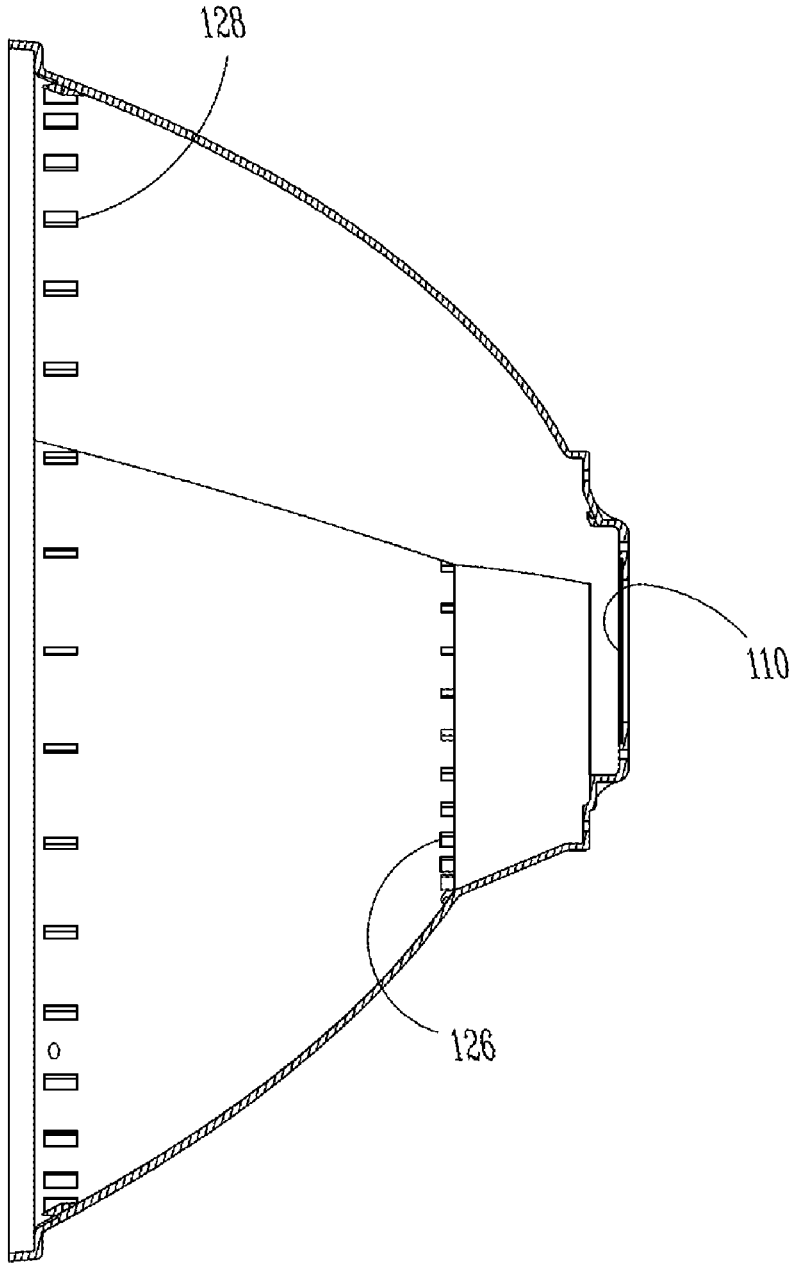

FIGS. 11A-C are various views of an alternative reflector frame.

FIGS. 12A-E are various views of an alternative reflector frame.

Figure 13A:
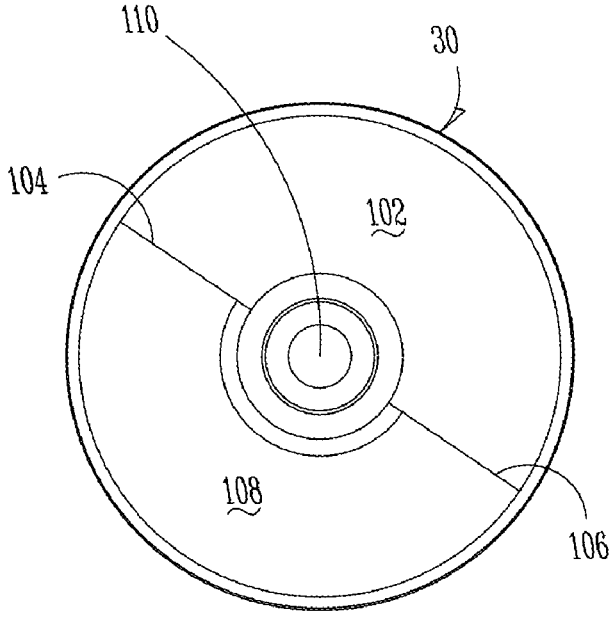
Figure 13C:
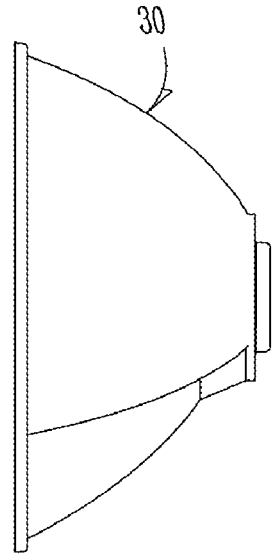
Figure 13B:
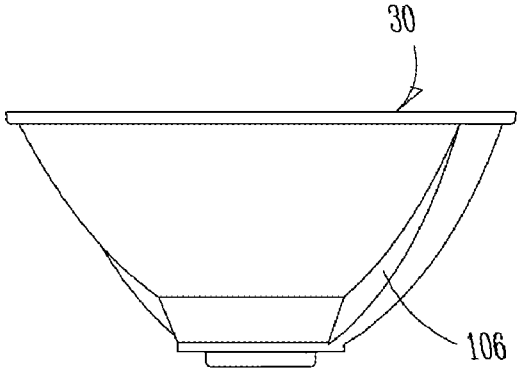

FIGS. 13A-C are various views of an alternative reflector frame.

Figure 14A:
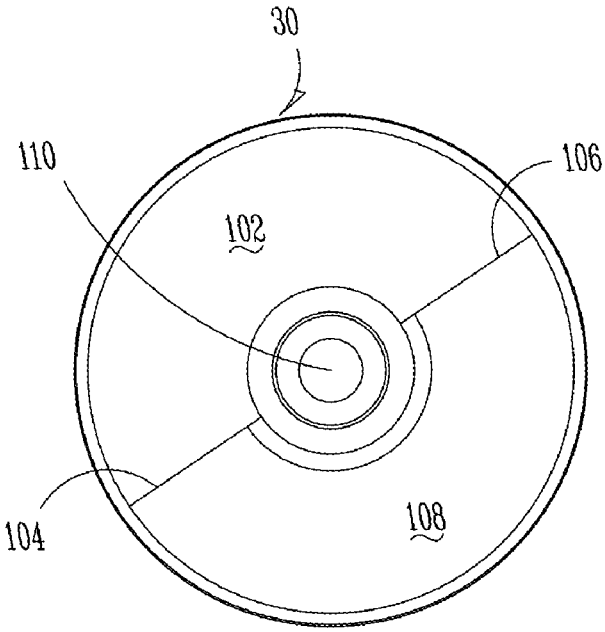
Figure 14C:
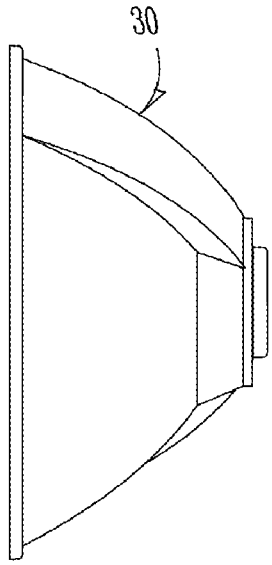
Figure 14B:
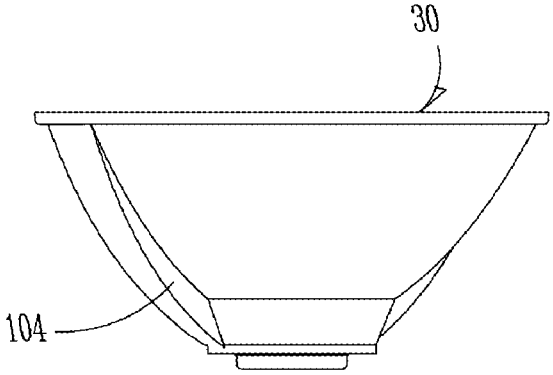

FIGS. 14A-C are various views of an alternative reflector frame.

Figure 15A:
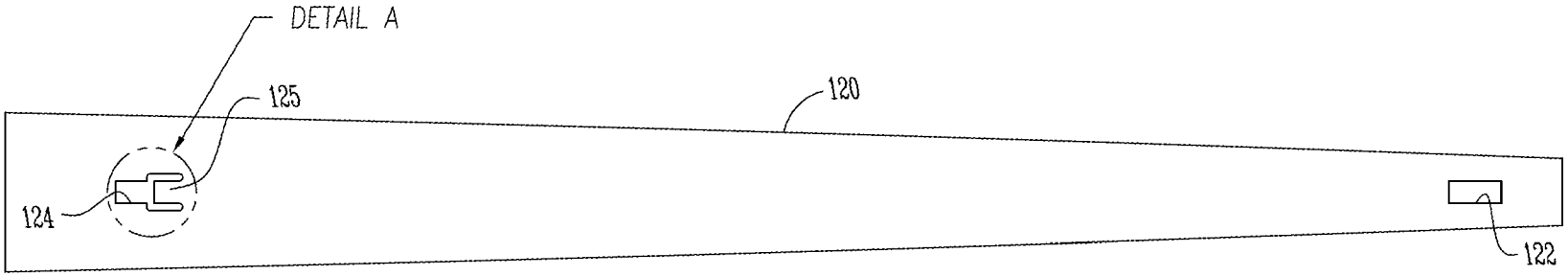
Figure 15B:
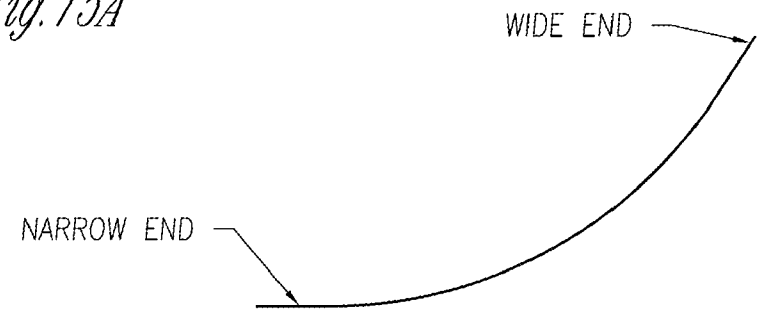
Figure 15C:
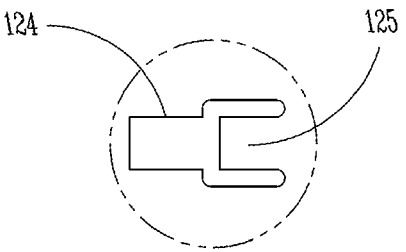

FIGS. 15A-C are various views of a reflective insert that can be removably positioned inside a reflector frame.

Figure 16A:
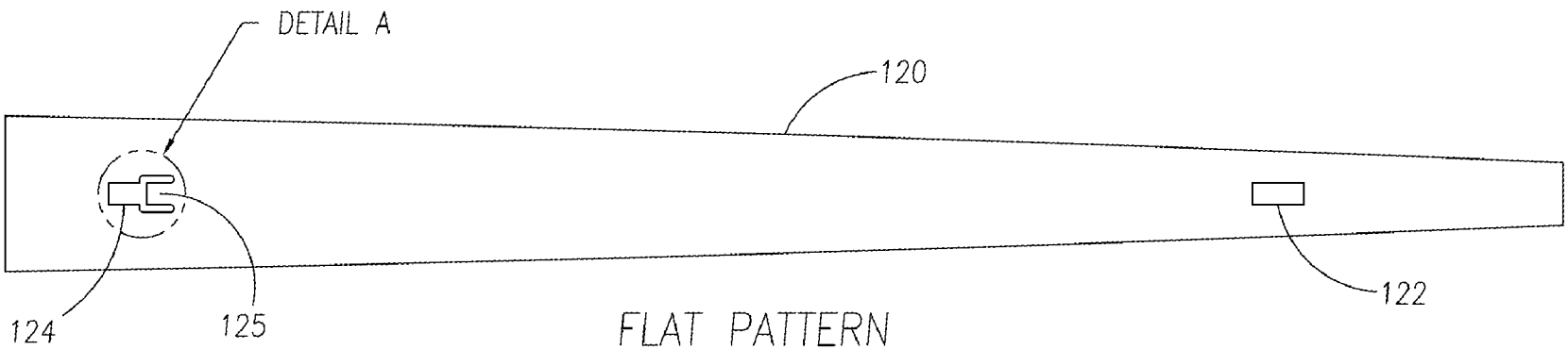
Figure 16B:
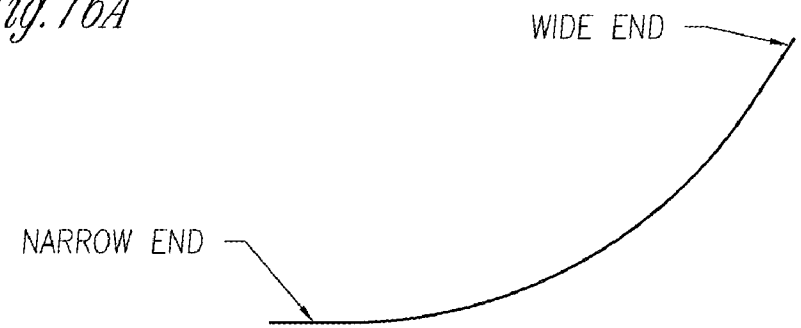
Figure 16C:
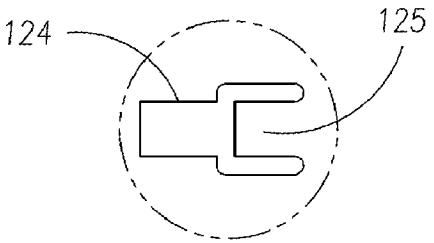

FIGS. 16A-C are an alternative embodiment of a reflector insert.

Figure 17A:
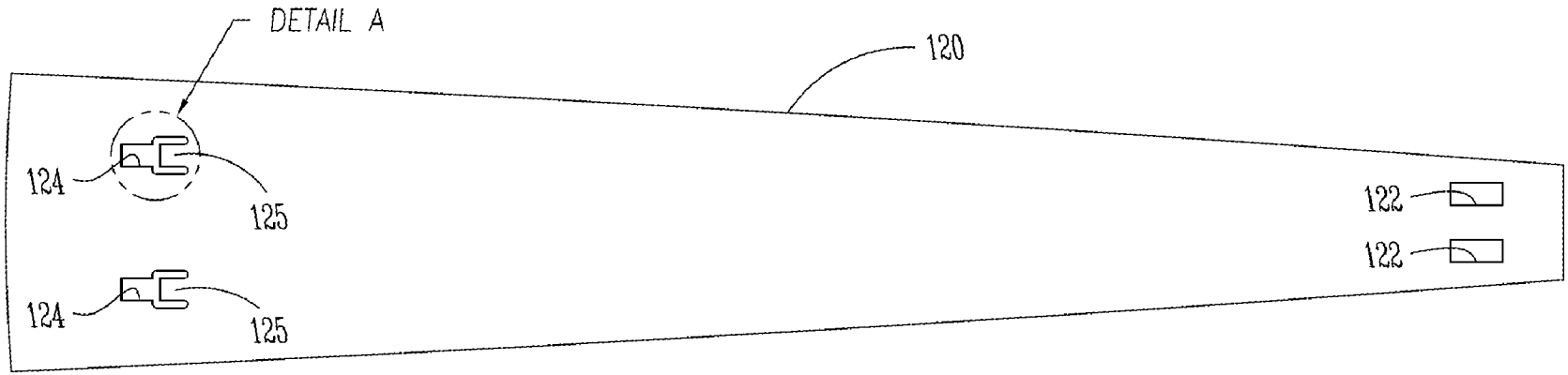
Figure 17B:
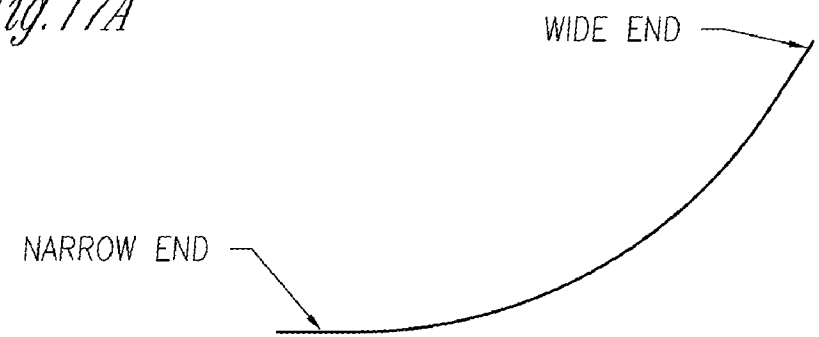
Figure 17C:
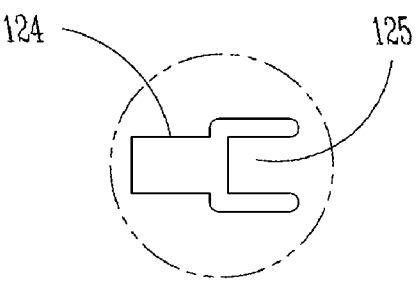

FIGS. 17A-C are an alternative embodiment of a reflective insert.

Figure 18A:
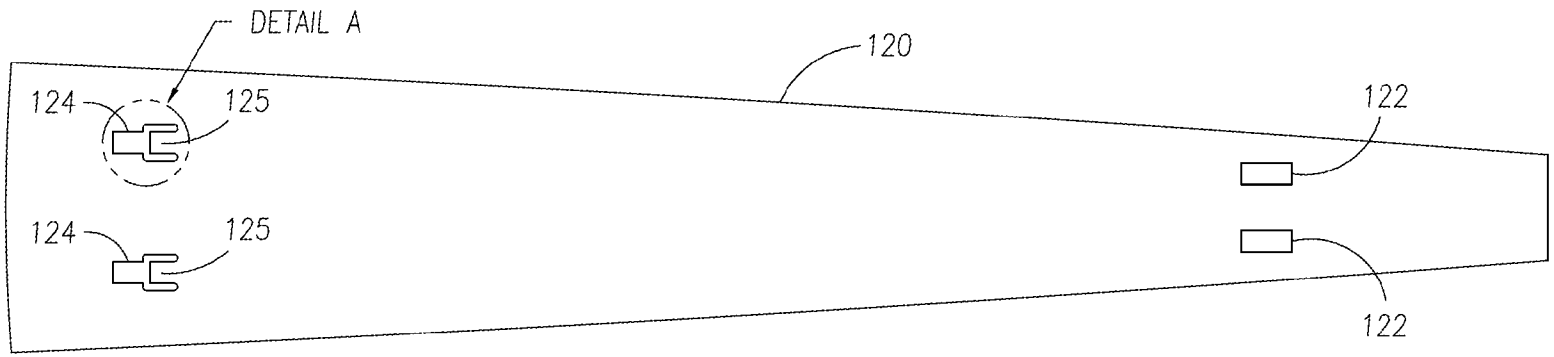
Figure 18B:
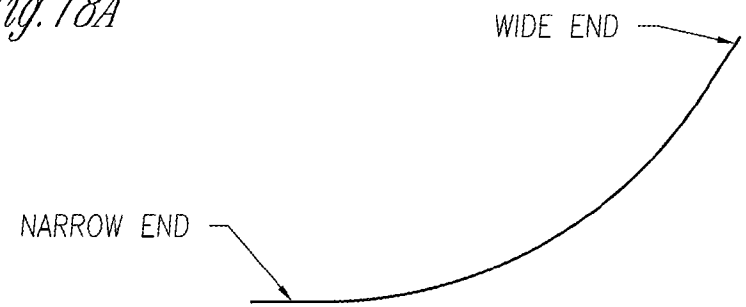
Figure 18C:
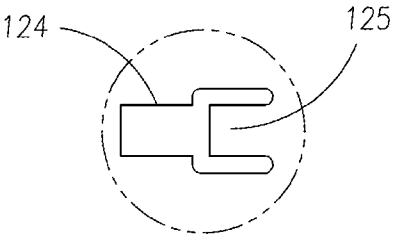

FIGS. 18A-C are another alternative reflective insert embodiment.

Figure 19A:
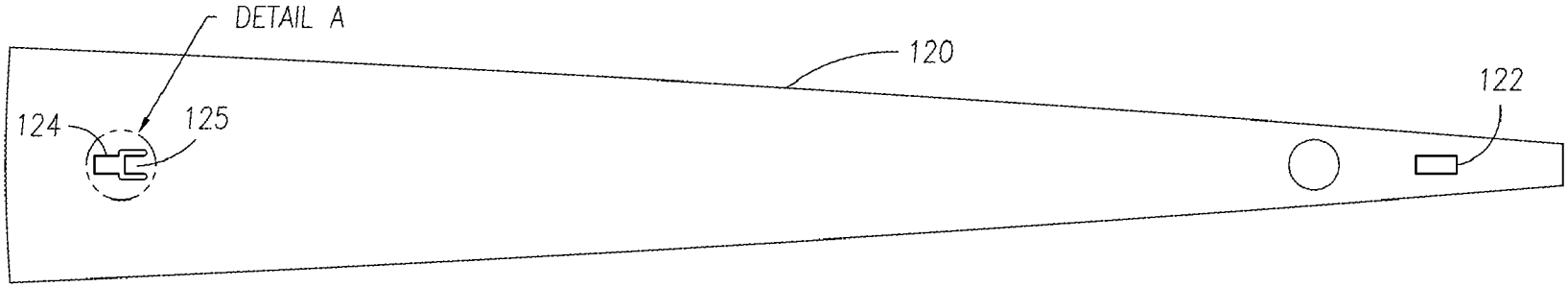
Figure 19B:
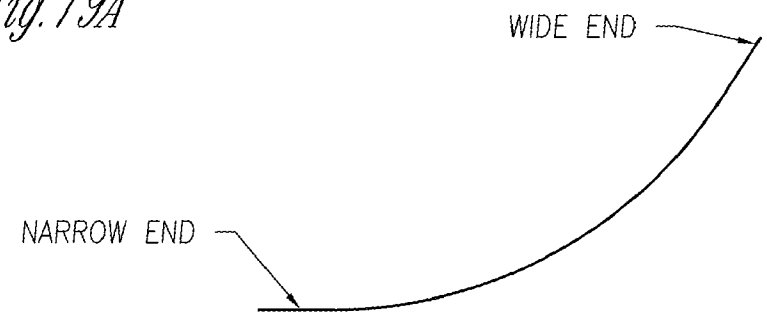
Figure 19C:
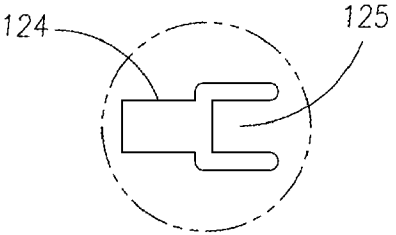

FIGS. 19A-C are another alternative embodiment of a reflective insert.

Figure 20A:
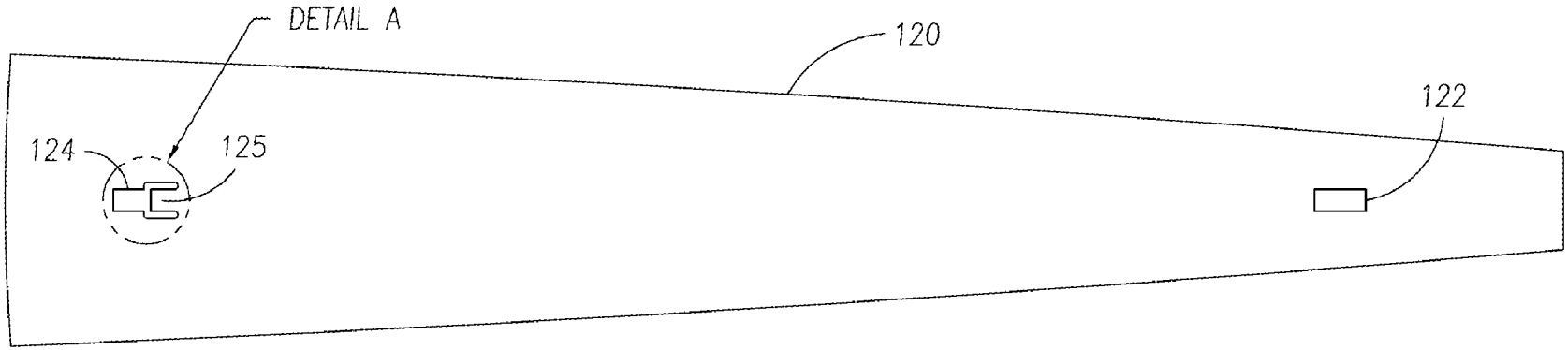
Figure 20B:
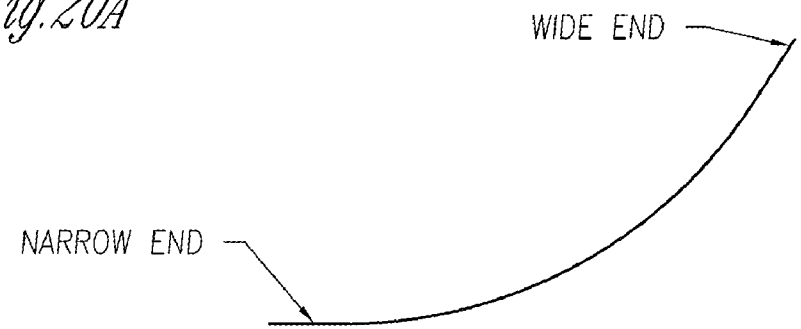
Figure 20C:
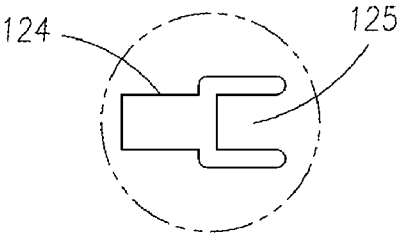

FIGS. 20A-C are another alternative embodiment of a reflective insert.

Figure 21A:
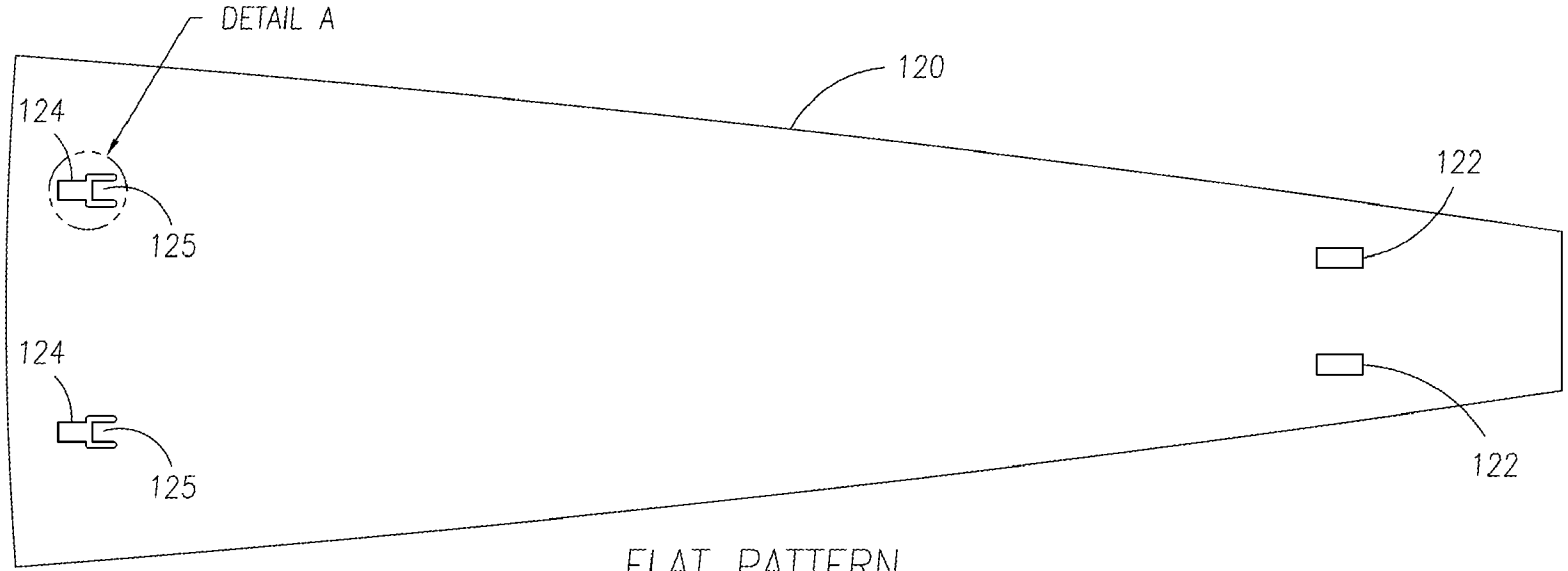
Figure 21B:
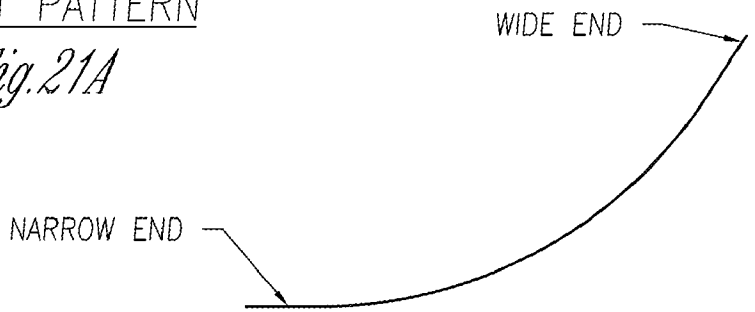
Figure 21C:
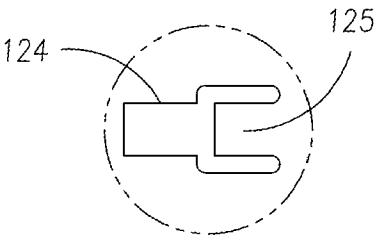

FIGS. 21A-C are another alternative embodiment of a reflective insert.

Figure 22A:
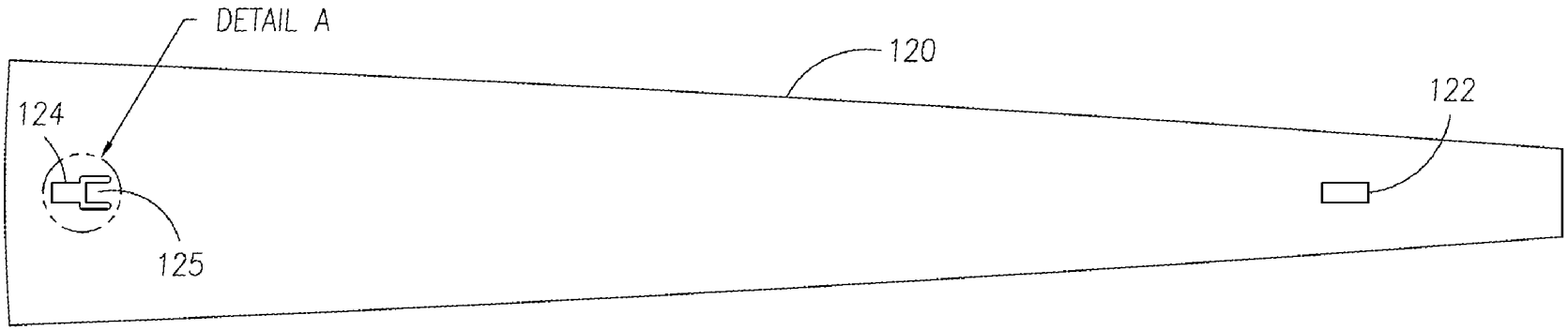
Figure 22B:
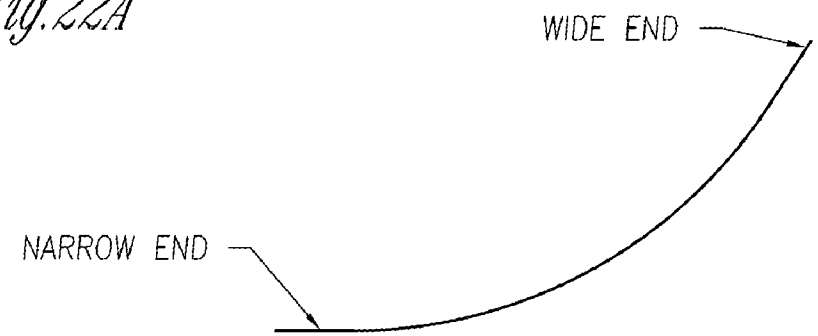
Figure 22C:
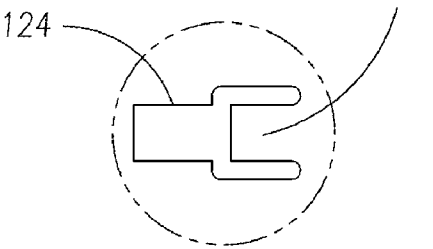

FIGS. 22A-C are another alternative embodiment of a reflective insert.

Figure 23A:
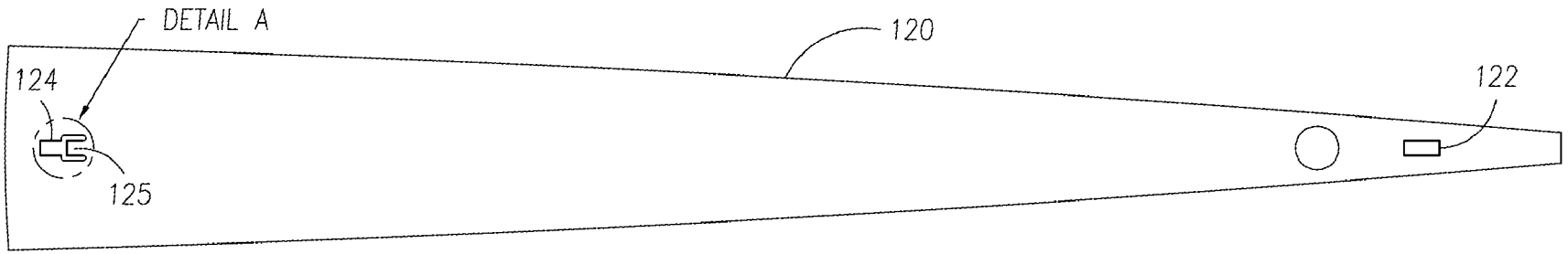
Figure 23B:
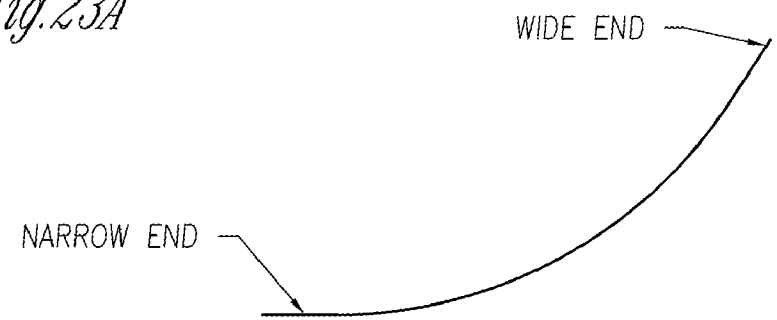
Figure 23C:
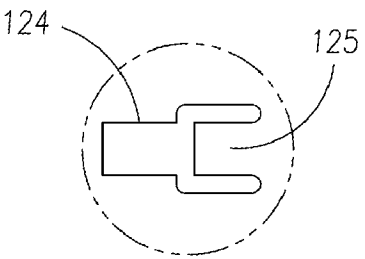

FIGS. 23A-C are another alternative embodiment of a reflective insert.

IV. DETAILED DESCRIPTION OF EXEMPLARY EMBODIMENTS

A. Exemplary Apparatus

Reflector frame 30 (cast aluminum type 413 e.g., see FIG. 6A and subparts) bolts to lamp cone 40. Primary reflecting surface 32, here comprising a number of high total reflectance rated side-by-side strips 120 (see FIGS. 15-23 and subparts), is mounted inside reflector frame 30. Reflector frame 30 has a main portion that follows a surface of revolution, but at least one differently oriented portion. Frame 30 is thus pre-designed to shift part of the light beam that will be generated by the reflecting surface once applied to frame 30. A frame 230 for glass lens 3 is removably latched to the front of reflector frame 30. Visor 70 is mountable to the lens frame and extends from the upper front of reflector frame 30 when in place. It includes high reflectivity strips 72 on its interior.

1. Reflector Frame 30 Generally

FIGS. 2, 3A and B, 4A and B, and 6A and subparts, illustrate details of reflector frame 30. It is die-cast aluminum (e.g., aluminum type 413). It could be made of other materials (e.g. powder-coated steel). Unlike state-of-the-art bowl-shaped spun aluminum reflectors, it does not have any surface that is intended for controlled reflection of light to the target area. Therefore, it does not require much post-casting processing. It provides the basic framework or support for primary reflecting surface 32, which shapes and controls most of the light beam of fixture 10. It does have basically a bowl-shape with an external surface that is substantially closed and smooth.

Reflector frame 30 is thicker and stronger than a conventional spun aluminum reflector (an estimated 2 to 3 times stronger). Die-casting makes it economical to create different forms of reflector frame 30. Ironically, while being much more robust (able to withstand things such as hail, baseballs, and other forces) than typical spun aluminum reflectors, it has more flexible in configuration and can result in smoother, more controlled lighting to the field.

As shown in FIGS. 3A-B and 4A-B, bumps or projections 71A and B extend from the outside of reflector frame 30. These are ejector pins for die-casting so that the casting is not distorted. Die-casting provides for a very precise way to form the framework for the main fixture reflecting surface in an economical fashion.

When assembled, lamp 20 extends through opening 110 at the bottom or center of reflector frame 30 and is substantially centered in reflector frame 30. High reflectivity reflecting surface 32 surrounds a substantial part of the glass envelope of lamp 20 around an arc tube. An orthogonal plane laterally across the middle of arc tube (its equator) projects substantially to reflecting surface 32, but since arc tube in one embodiment is tipped up relative the center aiming axis of reflector frame 30 (the longitudinal axis of lamp 20 is generally along the center axis of reflector frame 30), part of its projected equator extends obliquely out the front opening of reflector frame 30.

Reflector frame 30 is generally in the shape of a common sports lighting surface of revolution (parabola or hyperbola or combinations thereof) because it supports a main reflecting surface 32 that produces a controlled, concentrated beam. Such a beam needs to be controlled in both vertical and horizontal planes. As shown at FIGS. 6A-V, a majority of reflector frame 30 (see reference numeral 102) follows a basic surface of revolution (e.g., parabolic or hyperbolic shape) between transition points 104 and 106—approximately the upper 244° of the frame 30 in this example. When reflecting surface 32 is overlayed over this section 102 of frame 30, fixture 10 captures and precisely controls a substantial part of the light energy from lamp 20 and concentrates it into a shape useful for sports lighting.

2. Lower Less Converging Section 108 of Reflector Frame 30

But reflector frame 30 includes another portion (see FIG. 6A and subparts, reference numeral 108) of a different nature. It is not in the same shape as the surface of revolution of portion 102. In the version shown in FIG. 6A, section 108 is approximately 116° and centered in the lower hemisphere of the interior of reflector frame 30. When high reflectivity, primary reflecting surface 32 is applied over it, light is reflected in a less converging manner than from section 102, the section which follows a consistent surface of revolution.

Thus, reflector frame 30 is intentionally cast to include at least one section which supports high reflectivity material at a different, and less converging, orientation to the light source 20 and is not part of the general surface of revolution simulated by the rest of the reflecting surface 32, which is generally converging. This less converging part is easily designed and manufactured into fixture 10, because reflector frame 30 is cast and the reflecting surface is added to it (see, e.g., FIGS. 5A-C). Less converging section 108 is designed to redirect light from fixture 10 that otherwise would go off the athletic field and place it in a useful position for lighting the field. In essence, for normal aiming angles for sports lighting fixtures, light striking lower hemisphere less converging section 108 will be useable for lighting the field, as opposed to traveling horizontally or above horizontally and "spilling" off the field.

MUSCO® Corporation has previously altered part of the surface of revolution of ordinary conventional bowl shaped spun reflectors to alter the direction of light from that portion of the reflector. See, for example, U.S. Pat. No. 4,947,303, incorporated by reference herein. However, that method involved adding a separate insert piece over the spun reflector reflecting surface or mechanically peening or etching that part of the spun reflector to alter the reflecting properties of that part of the reflector. In fixture 10 of the embodiment of the invention, use of a cast reflector frame 30 allows nonreflecting supporting structure, separate from the reflecting surface, to be built into the reflector supporting framework. It avoids having a separate overlay piece or alteration of reflective surfaces.

3.Side Shift Sections 109 of Reflector Frame 30

Optionally, reflector frame 30 can have additional areas that can be modified to support reflecting surface 32 to diverge light like the less converging section 108 described above. Section 109 (see, e.g., side-shift portion 109R in FIGS. 7A-D) differs in that it is on a lateral side of reflector frame 30 (and thus lateral to, or to one side of lamp 20 when in place). Its function is the same, however, to pull light that otherwise would go off field back onto the field. As indicated in the Figures, these side shift portions could be on either side reflecting frame 30 and could take different configurations. See reference numerals 109L and 109R of FIGS. 7A-14C for a variety of examples of different side shift configurations for fixture 10.

Thus, this "side shift" or generally horizontal shifting of light, can be particularly useful in sports lighting. It can allow light that otherwise might be glare or spill light to be "pushed" or shifted back onto the field. It also allows either placement of additional light onto a certain area of the field without added more fixtures or, conversely, removing some light from a certain area.

As can be appreciated, the ability to reduce glare and spill from one fixture can be significant. Substantially eliminating what otherwise would be light that spills outside the field (e.g. onto a neighbor's property) or causes glare (e.g. to a driver on an adjacent street), even for one fixture, can be very beneficial. But moreover, shifting light from a plurality of fixtures in a given lighting system can cumulatively significantly cut down on glare and spill light. Furthermore, shifting light in combination with reduced intensity from the fixture(s) (at least during an initial operational period for the lamps of the fixtures) can produce a substantial reduction in glare and/or spill light.

The die cast reflector, and the ability to precisely form a wide variety of shapes (and thus wide variety of light shifting functions), allows much flexibility to "push" light to locations where it is beneficial for the lighting application and/or "pull" light away from where it would not be considered beneficial. An on-field example would be to shift more light just behind second base in a baseball field. Another example would be to decrease spill light from the end zone corner of a football field. Or both on-field and off-field light shifting could take place. It could be to either increase or decrease light at some part of the sports field, or redirect light that otherwise would go off the field so that it is added to the light going on the field. A designer can select the location and intensity of light virtually anywhere in a target space. While such things as beam width, distance to target, etc. have some bearing on the amount of light shift, the benefits described above can be enjoyed. Thus, a single fixture or a plurality of fixtures for a given lighting application can have a beam shifting or light shifting component such that a lighting application can be customized.

B. Assembly and Use

In practice, a set of fixtures 10, such as described above, would be used in a sports lighting system customized for a particular sports field. Lighting specifications (usually including light quantity and uniformity minimums; and sometimes glare, spill, and halo light limitations) are usually prepared or known. As is well known in the art, computer software can design the lighting system, including what types of beams and beam shapes from how many fixtures at what locations are needed to meet the specifications. It can generate a report indicating number of fixtures, pole locations, beam types, and aiming angles to meet the design.

As described above, fixtures 10 can be assembled to produce a wide variety of beams and commonly used beam shapes for sports lighting. Using the report, a set of fixtures 10 can be pre-assembled at the factory. The appropriate reflector frame 30 for each beam type called for in the report can be pulled from inventory by the assembly worker. About one-half the reflector frames will include a side shift section 109 (and about one-half of those split between left shift and right shift) Likewise, the appropriate reflector inserts 120, visor 70A or B, and visor reflective inserts 72 will be pulled from inventory for each fixture according to its position and function in the report.

The assembly worker(s) will mount the appropriate reflective inserts 120 on the pins on each reflector frame 30, and the appropriate visor reflective strips 72 on visor 70 for each fixture 10 (depending on the precise structure of visor 70, mounting straps or brackets may first be secured to visor 70). Glass lens 3, with anti-reflective coatings on both sides installed, is assembled into lens rim 230 with visor 70 attached.

Further description of reflector inserts 120, options and alternatives, and how they can be mounted on different reflector frames 30 is set forth below.

1. High Reflectivity Primary Reflecting Surface 32 (Reflector Inserts 120)

Reflecting surface 32 is independent of reflector frame 30. In this exemplary embodiment, reflecting surface 32 is made up of a set of elongated strips of high reflectivity sheet material which will be called reflector inserts 120. The shape (e.g. width), specularity (e.g. more diffuse or more shiny), and surface (e.g. smooth, stepped, peens, texture) can be varied from insert 120 to insert 120, or they all can be similar.

One example of a reflector insert 120 is illustrated in FIGS. 15A-C. It is made from 0.020 inch thick Anolux MIRO® IV anodized lighting sheet material (available from Anomet, Inc. of Brampton, Ontario, CANADA). It has high total reflectance (at least 95%). It can be formed into curved shapes. FIG. 15B shows one formed profile ready to be installed on pins 126 and 128 (see, e.g., FIG. 6D). The material has a base layer of high purity aluminum chemically brightened to form a hard clear surface of oxide, with a super reflective vapor deposited as a thin film outer layer. This results in a relatively hard, durable surface that reflects a minimum of 95% of visible light rays incident upon it. The material comes in flat sheet form. Inserts 120 are cut out to desired shape and are flat. A thin plastic, self-adhering releasable protection sheet is added over the reflecting side to keep fingerprints or other foreign substances from the reflecting surface during handling.

The temporary protective release sheet can be placed over the reflective side of the strips 120 when manufactured. A score line can be manufactured into the sheet to allow "break and peel" removal of the release sheet. When a fixture 10 is assembled, the worker can install each strip 120 without worrying about fingerprints or other substances attaching to strip 120 (he/she can grasp an insert 120 and even touch both front and back sides without leaving fingerprints on the reflecting side. But at the appropriate time during assembly, release sheet can be quickly and easily removed by peeling it off.

When installed in position on reflector frame 30, reflector insert 120 is basically captured between inner and outer pins 126 and 128. It does not have to rely precisely on the solid surface of reflector frame 30 behind it to define its form, but reflector frame 30 does provide the basic support and shape for reflector inserts 120 because each insert is suspended on two pins on the bowl-shaped reflector frame 30.

The material for inserts 120 has high consistency from piece to piece because it is made in large sheets under stringent and highly controllable manufacturing conditions. A subtlety of the material is that it is more efficient in reflecting light (thus more light that can be used to go to the field), but also its very high reflectivity results in much more precise control of the reflected light (it minors the light source more precisely). This adds greatly to the effectiveness and efficiency of fixture 10 in a sports lighting system for a sports field.

Alternatives for reflecting surface 32 is a silver coated aluminum are available from commercial sources (e.g. Alanod Aluminum, Ennepetal, Germany). This type of material can achieve higher reflectivity (perhaps 3 percent higher) than the previously described material, but is not as durable.

FIGS. 15A-23C illustrate various examples of reflector inserts 120 that can be mounted to the interior surface of reflector frame 30. The pre-manufactured, high reflectivity strips 120 do not need polishing or other processing steps that are many times required of spun aluminum reflectors. Therefore, another cost of conventional spun aluminum fixtures is avoided. And the color separation or striations that plague spun aluminum reflectors after polishing are avoided because strips 120 are flat in one plane (although mounted along a curve in another plane) and are not polished after manufacture.

In one exemplary embodiment, thirty-six inserts 120 (when 2 inches wide at base) are mounted on reflector frame 30. The nature of each insert selected, and its position on frame 30 depends on the type of light beam desired for the fixture. Width, curvature when installed, and surface characteristics of inserts 120 can all be designed to produce the type and characteristics of a beam needed for that particular fixture for a particular field.

Inserts 120 can be custom designed for a fixture. Alternatively, an inventory of a limited number of styles, all capable of being installed on a pair of pins 126 and 128 of reflector frame 30, and capable of producing many of the standard beam types needed for sports lighting, could be created. Specific reflective inserts 120 for each fixture for a lighting system for a field can be determined according to computerized programs and/or specifications for the field. Workers can therefore easily select and install the appropriate inserts 120 for a given fixture without experimentation or expertise in lighting design. They basically have to match an inventory item to the specification for that fixture.

Each insert has formed openings 122 and 124 (see, e.g., FIG. 15A) towards opposite ends that are adapted to cooperate with a set of inner and outer mounting pins 126 and 128 on the interior of reflector frame 30. The spacing and configuration of each set of openings 122 and 124 on each reflector insert 120, and the corresponding set of inner and outer pins 126 and 128 on reflector insert frame 30, allow quick and easy securement or removal of inserts 120. They are positioned and secured without any fasteners. There is no need for tools.

FIGS. 9A 5A-12E illustrate details about inner and outer pins 126 and 128 and how insert 120 can be mounted. The rectangular opening 122 (FIG. 15A) of a reflector insert 120 is brought vertically over an inner pin 126 until the plane of reflector insert 120 is at the level of slot 127 (e.g., FIG. 6M) of inner pin 126. Reflector insert 120 is then slid slightly forward relative to inner pin 126 so that the inner end of reflective insert 120 is held against movement. The outer wider end of reflector insert 120 is basically then snap fit over an outer pin 128. The small tongue 125 (e.g., FIG. 15A) extending into formed opening 124 of reflector insert 120 can deflect slightly but frictionally bites into pin 128 a bit and acts as a resilient force to hold reflector insert 120 into position on inner and outer pins 126 and 128. Once mounted on a set of pins 126 and 128, the curved shape of insert 120, and the inherent resiliency of the material it is made of, resists further bending or movement back to a flat configuration, including a tendency to want to draw towards lamp 20, a heat source, during operation.

Each reflector insert 120 essentially forms an individual small reflector of the light source (arc tube- and lamp 20). To create a highly controlled composite beam from a fixture 10, accuracy of installation and position in reflector frame 30 is important. The pin-mounting method for reflector inserts 120 allows accurate placement and deters change of shape or position of inserts 120 once in place. But further, it makes assembly of inserts 120 into fixture 10 quick and easy.

As can be appreciated, different styles and configurations of reflector inserts 120 can be created for different lighting affects. This is not easily possible with spun reflectors. As indicated in FIGS. 15A-23C, not only the precise curved profile, but also the width of reflector insert 120 can determine characteristics of the composite beam coming out of fixture 10. The principles involved are described U.S. Pat. No. 6,036, 338, incorporated by reference herein. Note that wider reflector strips 120 (for example see FIG. 17A) can include two pairs of inner and outer formed openings 122 and 124 and utilize two sets of inner and outer pins 126 and 128.

Figure 7A:
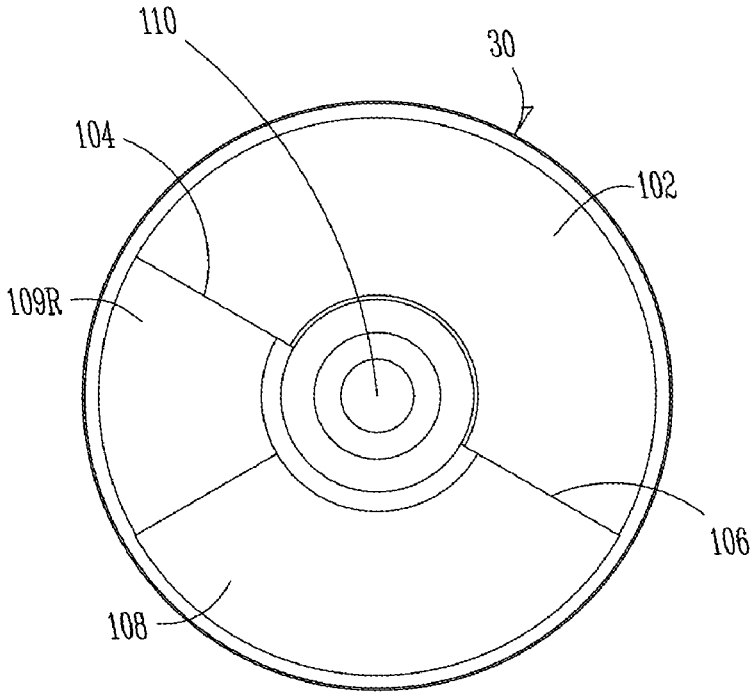
Figure 7C:
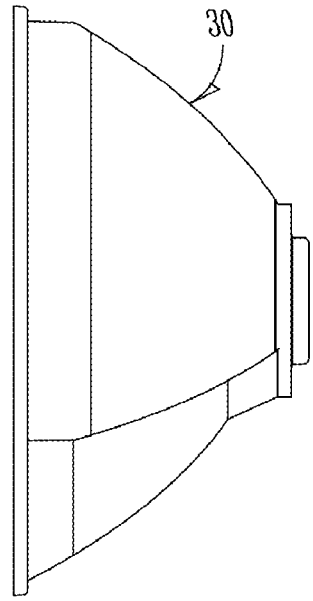
Figure 7B:
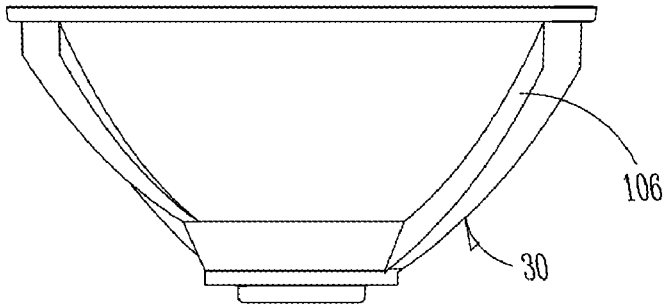
Figure 7D:
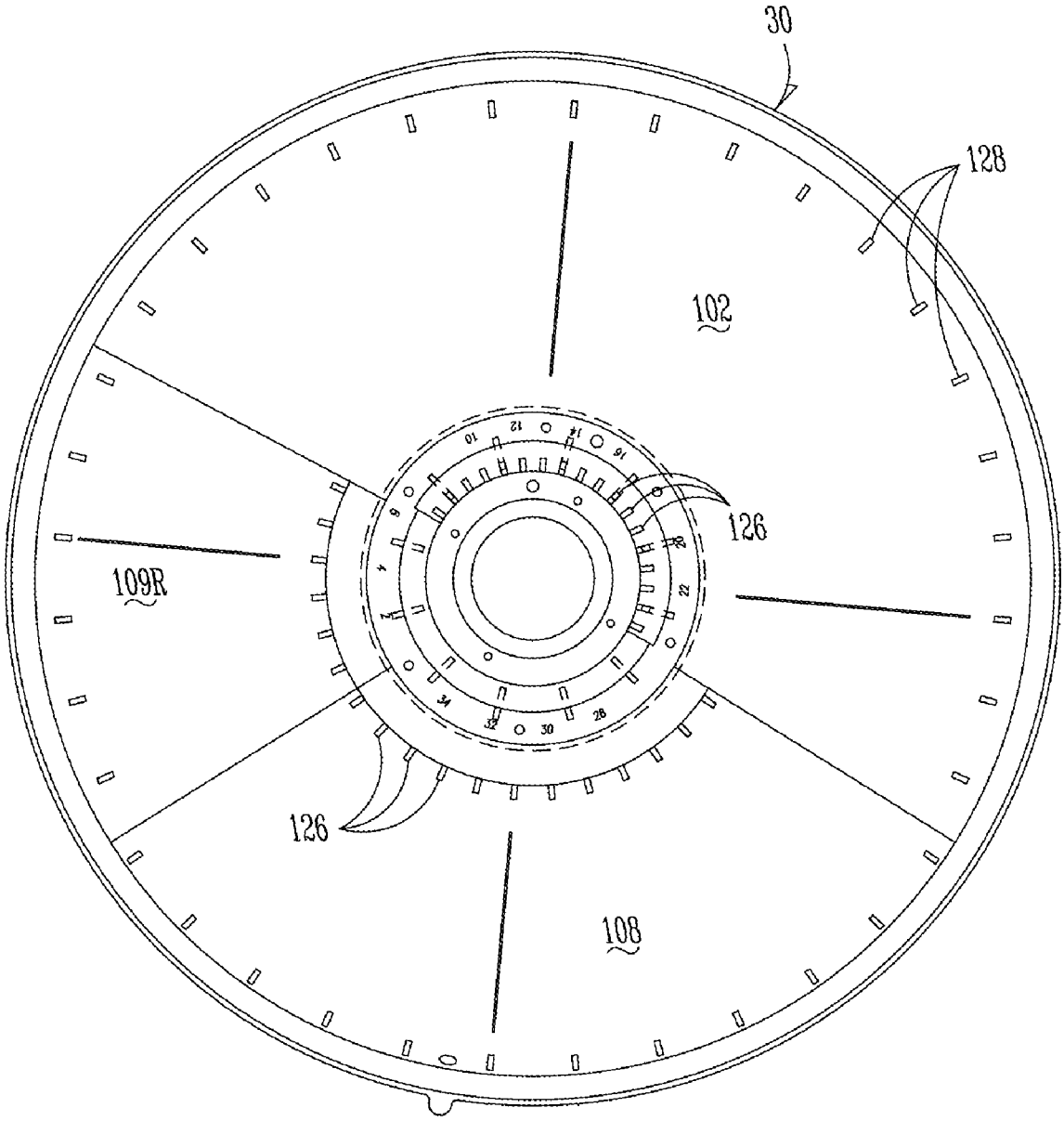
Figure 8A:
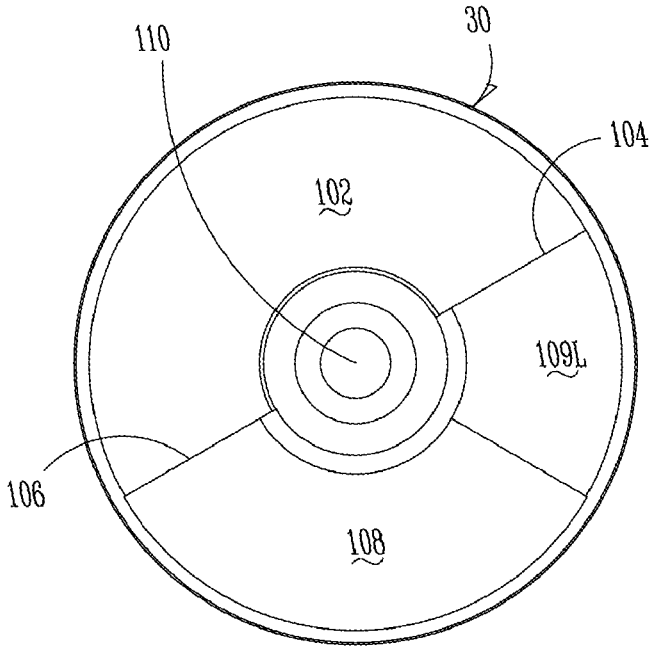
Figure 8C:
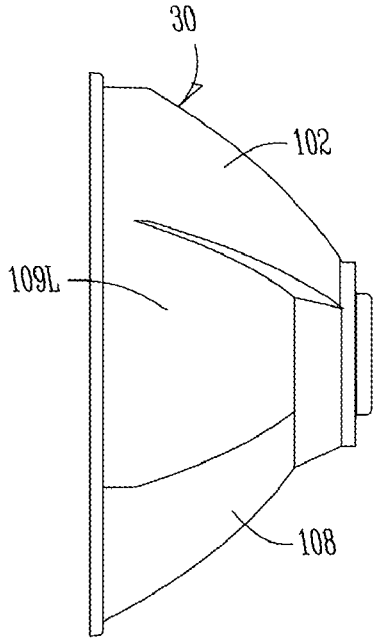
Figure 8B:
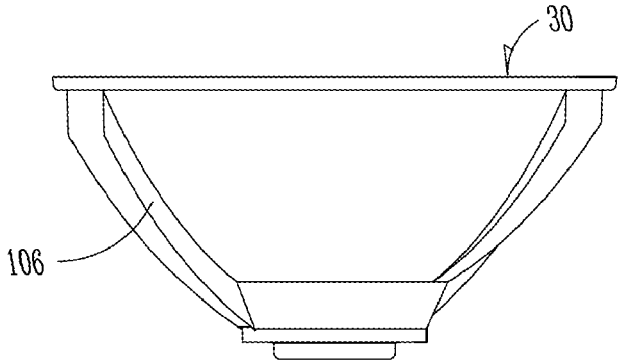
Figure 8D:
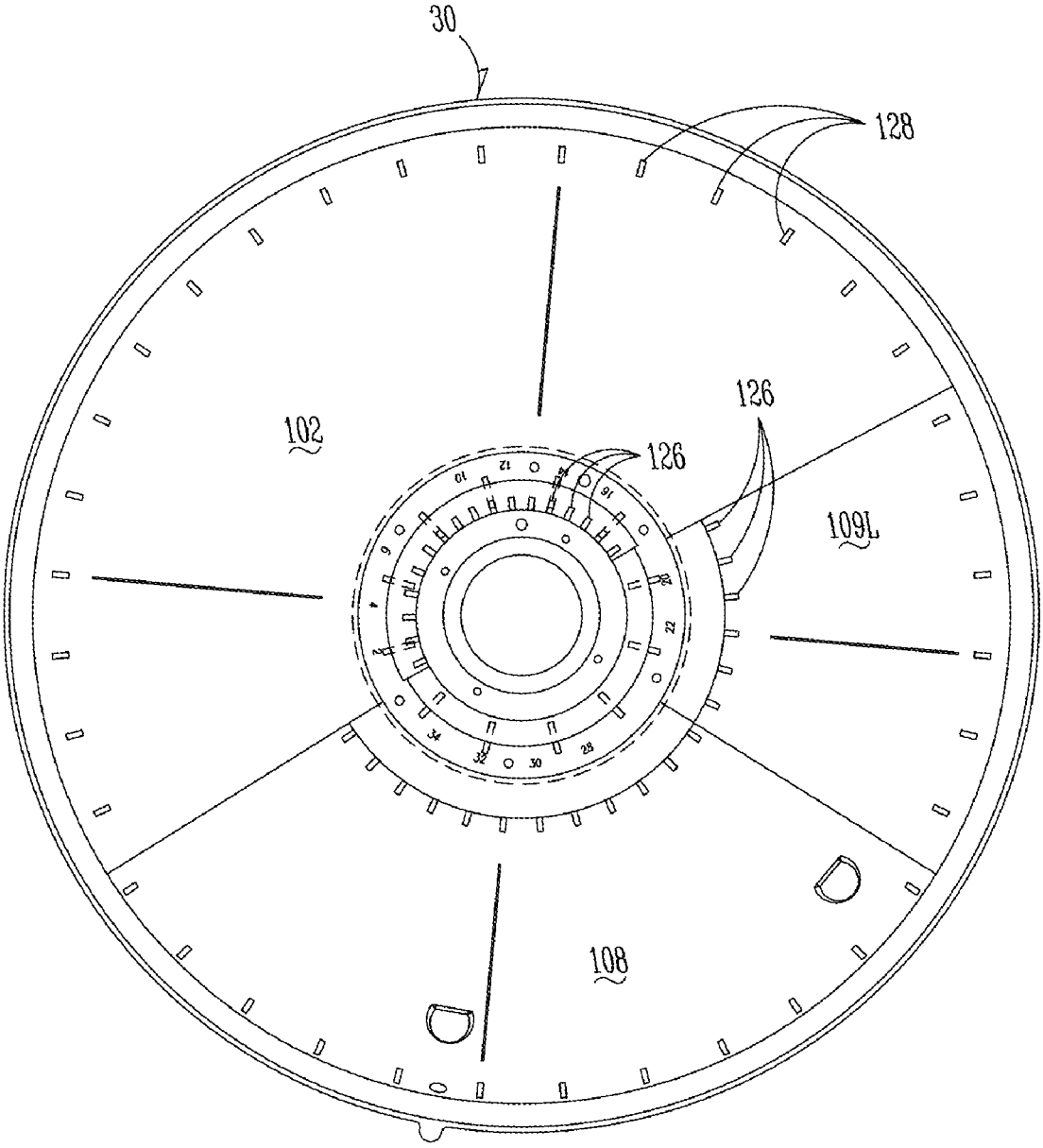
Figure 9A:
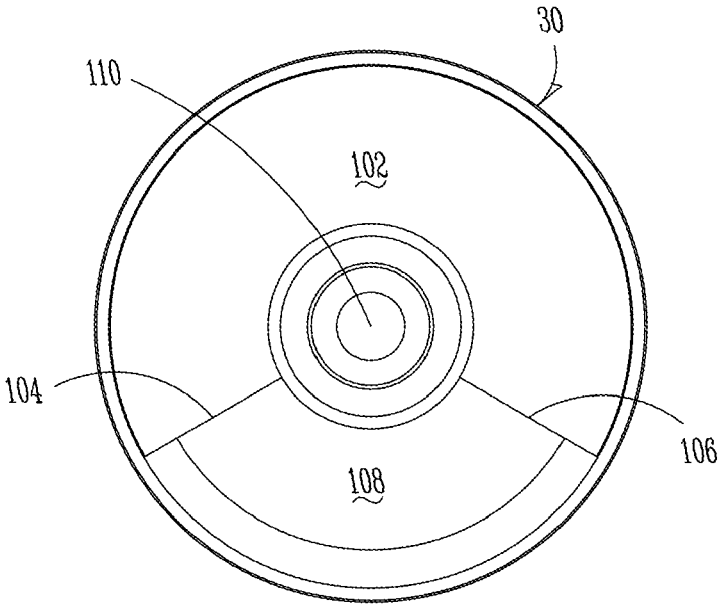
Figure 9C:
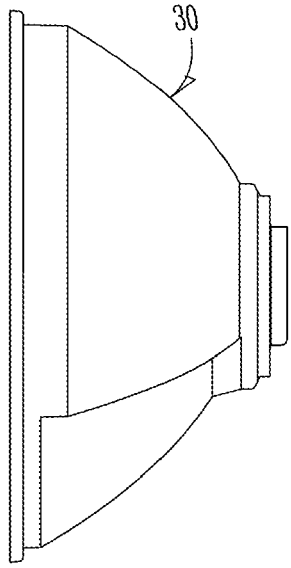
Figure 9B:
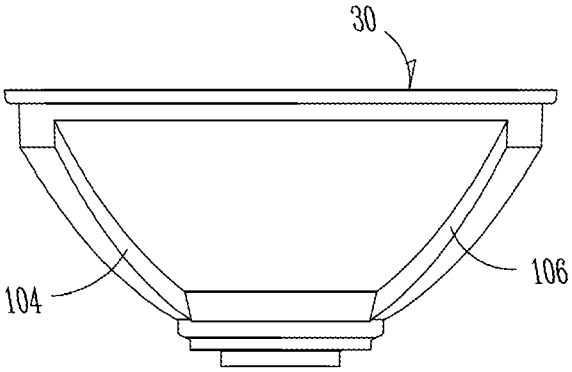
Figure 9D:
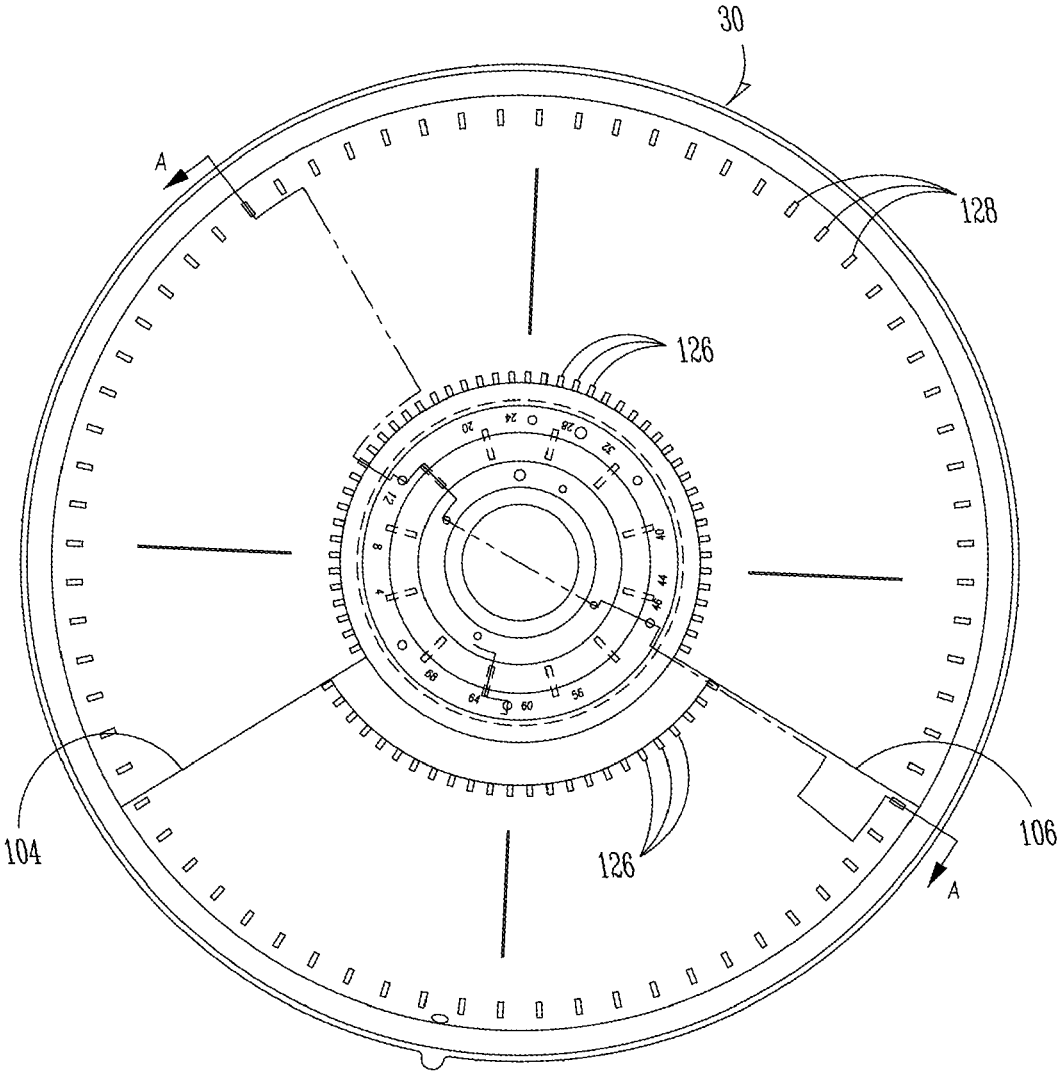
Figure 9E:
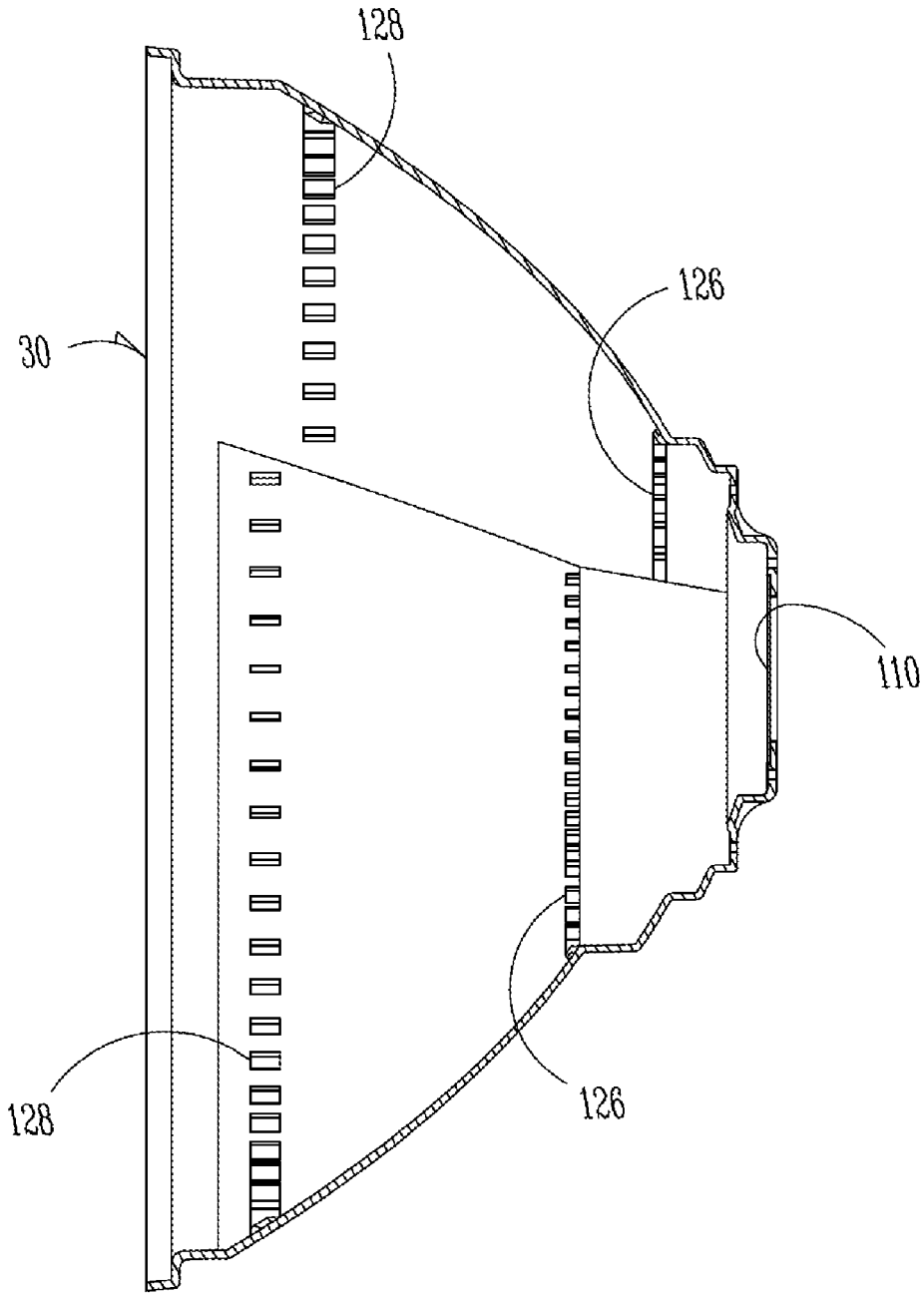

As can be seen in FIGS. 6D and 7D, pairs of inner and outer pins 126 and 128 are spaced differently for different parts of reflector frame 30. For example, in the main portion 102 of reflector frame 30, all pin pairs 126/128 are spaced equally apart a first distance. Pin pairs 126/128 in less converging portion 108 or side shift portion 109, have shorter but equidistant spacing, because reflector inserts 120 for those sections are shorter and different in curvature.

Different beam characteristics from the same reflector frame 30 can be created by using different reflector inserts 120. Examples of inserts 120 are shown in the drawings. These examples fall into three broad categories: (a) two inches wide at the lens end for a medium width beam (e.g., FIG. 22A); four inches wide (lens end) for wider horizontal beam spread (e.g., FIG. 21A, where lighting is accomplished with less fixtures), and one inch (lens end) for quite narrow spread (usually for fixtures far away from target) (e.g., FIG. 15A). Other configurations are, or course, possible. Different widths, specularity, shape, and reflecting surfaces can be designed for different lighting effects. Inserts 120 can be the same for a whole fixture 10, or can vary.

On the other hand, the same reflector inserts 120 could be applied to differently shaped reflector frames 30, without modification, and produce a different beam shape for fixture 10. FIG. 6A and subparts illustrate a reflector frame and reflector inserts which would produce a medium reflector type 3 beam, such as is well-known in the art. As can be appreciated by those skilled in the art, other types of beams can be created with different shaped reflector frames 30 (e.g., wide reflector type 4, narrow reflector type 2, etc.) with the use of appropriate reflector inserts.

Additionally, less converging lower section 108 or less converging side shift section 109 can change the nature of the beam from fixture 10. Different configurations for less converging section 108, with or without a left or right side shift section 109 for a reflector frame 30 are illustrated in FIGS. 7A-14C. FIGS. 6A-V, 12A-E, and 9A-E illustrate variations on a less converging lower hemisphere portion 108 such as previously described. FIGS. 7A-D, 10A-C, and 13A-C add what will be called a right side shift section 109 in addition to a downward less converging section 108. Portion 109R, on a lateral side of reflector frame 30, has a shape different from the main portion 102. It can also be different from the less converging portion 108. As can be appreciated, by election of that shape, light incident upon primary reflecting surface 32 placed over side shift portion 109R can be made less converging than main portion 102. Such light would therefore tend to be directed more directly out and to the right of the page, e.g., when looking at the back of the reflector (i.e., the non-illustrated portion) in FIG. 7A. For fixtures at aiming orientations to the target that otherwise would project light off of the target, section 109 can shift a substantial amount of that light back to the target. The typical side shift is approximately 60% of the 360° of the main reflector surface 32.

Similarly, FIGS. 8A-D, 11A-C, and 14A-C illustrate variations of a left side shift. Section 109L is added to reflector frame 30 to shift light that would otherwise converge towards the aiming axes of the reflector and then cross at axes to an off target site, and instead shift that portion of the light back to the target.

Note that FIGS. 6-14 and sub parts illustrate but a few examples of configurations for portions 108 and 109. Others are, of course, possible.

Beam customization is possible by taking advantage of the ability to easily build in variations to reflector frame 30, such as less converging section 108 or side shift section 109L or R. These sections of frame 30 can be readily manufactured with no or nominal extra cost because of the ability to cast frame 30. Almost infinite beam shape possibilities exist also because of the ability to form any number of different reflective inserts 120 (with any number of reflective characteristics) that can be interchanged on frame 30.

In addition to width of inserts 120, other features may be modified to produce different reflective characteristics. For example, facets or other surface variations could be added to any insert 120 or portions thereof. One example is facets on inserts 120 used on side shift section 109L or R. Another example is a stepped reflective surface. Another is a combination of facets or steps with smooth surfaces. Another is paint over a part of the reflective surface. Any of these could allow more customization and flexibility with regard to the shape and nature of the beam from fixture 10. Examples of these types of surfaces for strip or sheet like high reflectivity material are described in U.S. Pat. No. 6,036,974.

Facets tend to diffuse light. Some inserts could have facets and some not in the same fixture 10. This allows mixing and matching of light from each fixture, or relative to other fixtures in the system. An example use for faceted or stepped inserts is to remedy what is known in the art as "B pole phenomenon". Stepped inserts in the upper 40%-60% of the fixture can be used to eliminate this problem.

The high reflectivity inserts not only increase the amount of light from the fixture over lower reflectivity reflecting surfaces like spun aluminum reflectors, but reduce glare and put more light on the field because of the precise control of light available with such efficient reflection. The reflector inserts 120 can be selected and mounted on the die cast reflector frame. The die cast reflector frame does not have to be changed for every desired change in light output. Although several different reflector frame styles can be made (e.g. left shift, right shift, no shift, etc.), it is not like spun aluminum reflectors where each beam shape requires specific manufacturing steps for each reflector.

An optional feature of inserts 120 is that they be stepped from inner end to outer end. One or more steps could serve to spread light in one direction (or take light away—e.g. reduce glare or spill). Each step can be formed over a die. They are a very efficient way to change the direction of light. They could be used instead of the side-shift version of the die cast reflector frame. They even could be put into conventional spun aluminum reflectors to shift light.

Just one insert could shift some of the light output of a fixture. For example, one stepped insert could spread light from one portion of the composite beam of a fixture (i.e. create a relatively small bump out from the perimeter of a generally circular beam.

Multiple stepped inserts could spread a larger portion, or all of the beam. Conversely, different shape stepped inserts could decrease the perimeter of a small, substantial, or whole beam. Steps would likely be no more than ¼ inch. More commonly they would be on the order of 0.080 or 0.160 inch in height per linear inch. Steps do not have to be constant in placement or height.

It can therefore be seen that selective use of inserts 120 can shift light from the beam of a fixture. This can be very useful for glare or spill light control.

It will be appreciated that inserts 120, including the ability to change them out, provides substantial flexibility to fixture 10. Using the same die cast or other reflector frame or main body, future modifications can be made. For example if the glare and spill light requirements for a certain lighting application become more severe after initial installation, inserts 120 could be changed to meet the new requirements.

The various beam shapes and configurations possible by shaping reflector frame 30 and selection of reflective inserts 120, etc. has been described above.

D. Options and Alternatives

It will be appreciated the present invention can take many forms and embodiments. Variations obvious to those skilled in the art, which is defined solely by its claims.

There can be a slight overlap between inserts 120 (e.g. 0.060 inch).

What is claimed is:

1. A high intensity lighting fixture for producing a substantially controlled, concentrated light beam to a relatively distant target area comprising:

a. a reflector frame comprising an inner surface including mounting structure and a primary opening over which a glass lens is mountable and through which extends a central beam axis, the reflector frame comprising:

i. a body comprising an inner surface including the mounting structure adapted to removably receive a reflecting surface;

ii. the inner surface having a first sector generally following a first surface of revolution and a second sector that is not completely aligned with the first surface of revolution;

iii. the mounting structure on each of the first and second sectors of the reflector frame defining the mounted orientation of a reflecting surface when mounted thereto, b. a very high total reflectance reflecting surface removably mountable to the mounting structure of the reflector tram; the reflecting surface comprising:

i. a first reflecting section mounted on a first reflector frame sector generally following a surface of revolution relative to the central beam axis producing a first beam portion of the substantially controlled, concentrated light beam around the central beam axis; and ii. a second reflecting section mounted on a second reflector frame sector generally following another surface of revolution relative to the central beam axis but producing a second beam portion of the substantially controlled concentrated light beam which is shifted relative to the first beam portion;

c. a connecting member having a first interface adapted for mounting to an elevating structure, and a second interface adapted for mounting to the reflector frame.

2. The fixture of claim 1 wherein the second sector is in a (a) bottom part or (b) side part of the frame.

3. The fixture of claim 1 wherein the frame comprises a shape that produces the first sector and second sector.

4. The fixture of claim 3 wherein the frame is cast.

5. A high intensity lighting fixture for producing a substantially controlled, concentrated light beam to a relatively distant target area comprising:

a. reflector assembly comprising a primary opening over which a glass lens is mountable and through which extends a central beam axis;

b. a reflecting surface in the reflector assembly; the reflecting surface comprising:

i. a first reflecting section mounted generally following a surface of revolution relative to the central beam axis producing a first beam portion of the substantially controlled, concentrated light beam around the central beam axis; and ii. a second reflecting section generally following another surface of revolution relative to the central beam axis but producing a second beam portion of the substantially controlled concentrated light beam which is shifted relative to the first beam portion;

c. a connecting member having a first interface adapted for mounting to an elevating structure and a second interface adapted for mounting to the reflector assembly.

6. The fixture of claim 5 wherein the second reflecting section is in a (a) bottom part or (b) side part of the reflector assembly.

7. The fixture of claim 5 wherein the reflector assembly comprises a shape that produces the first sector and second reflecting sections.

8. The fixture of claim 5 wherein a portion of the reflector assembly is cast.

9. A method of high intensity lighting comprising:

a. providing a reflector assembly having an inner surface with a first sector generally following a first surface of revolution and a second sector that is not completely aligned with the first surface of revolution and a lens covering an opening;

b. mounting to the reflector assembly an independent reflecting surface generally following the first and second sectors;

c. so that a composite concentrated and controlled light beam can be produced by the combination of the reflecting surface on the first and second sectors with a part of the beam defined by the second sector shifted relative to the part of the beam defined by the first sector.

10. The method of claim 9 wherein the second sector is generally horizontally lateral from a center axis of the reflector assembly when in operating position.

11. The method of claim 10 wherein the second sector is of generally less converging reflecting characteristics than the first sector so that some light is shifted in an opposite lateral direction from the center axis.

12. The method of claim 9 wherein the reflector frame comprises a top, a bottom, and opposite lateral sides.

13. The method of claim 12 wherein the second sector is positioned at or near the bottom of the reflector frame.

14. The method of claim 12 wherein the second sector is positioned at or near one lateral side of the reflector frame.

15. The method of claim 12 wherein the second sector is positioned at or near the bottom and a lateral side of the reflector frame.

16. An apparatus used with a lighting fixture for producing a controlled concentrated light beam to a relatively distant target comprising:

a. a reflector assembly having an opening into an interior and a reference axis extending out of the opening and a removable lens mounted over the opening to the interior of the reflector assembly;

b. a fixture mount extending from the reflector assembly and having a first structure to mount to the reflector assembly and a second structure to mount to a support for elevating the fixture;

c. the interior of the reflector assembly comprising i. a first reflective surface mounting portion generally following a first surface of revolution relative to the reference axis for a substantial angular sector around the reference axis;

ii. a second reflective surface mounting portion generally following a second surface of revolution relative to the reference axis for another angular sector around the reference axis;

d. as first reflective surface comprising thin, flexible, sheet material removably mounted over and following the first reflective surface mounting portion;

e. a second reflective surface comprising thin, flexible, sheet material removably mounted over and following the second reflective surface mounting portion;

f. so that the first reflective surface, when mounted to the first reflective surface mounting portion, substantially produces the controlled concentrated light beam, and the second reflective surface, when mounted to the second reflective surface mounting portion, shifts a portion of light.

17. A method of high intensity lighting comprising:

a. capturing and controlling a majority of light from a high intensity light source into a high intensity converging light beam with a sheet material supported generally symmetrically on mounting structure surrounding at least approximately a majority of the circumference of the light source;

b. shifting a minority of light from the high intensity light source with a second reflective surface supported generally asymmetrically on mounting structure in a remaining minority of the circumference of the light source.

18. An apparatus used for producing a high intensity, controlled concentrated beam to a relatively distant target comprising:

a. a reflective surface around a reference position associated with a mounting location for high intensity light source;

b. the reflective surface comprising two sections;

c. each said section oriented relative to the reference position;

d. one section generally defining a first surface of revolution relative to the reference position;

e. the other section generally defining a second surface of revolution relative to the reference position.

19. The apparatus of claim 18 wherein the reflective surface comprises one or more relatively thin, flexible, highly reflective sheet pieces.

20. The apparatus of claim 19 wherein each sheet piece is a strip.

21. The apparatus of claim 20 wherein each strip has a longitudinal axis, first and second ends spaced apart on the longitudinal axis, and opposite sides along the longitudinal axis.

22. The apparatus of claim 21 wherein the opposite sides both converge between the first and second ends.

* * * * *

UNITED STATES PATENT AND TRADEMARK OFFICE

CERTIFICATE OF CORRECTION

PATENT NO. : 8,123,383 B2
APPLICATION NO. : 12/901909
DATED : February 28, 2012
INVENTOR(S) : Gordin et al.

It is certified that error appears in the above-identified patent and that said Letters Patent is hereby corrected as shown below:

Col. 11, Claim 1, Line 3:
DELETE: "tram;"
ADD: --frame;--

Col. 11, Claim 5, Line 26:
ADD after a. --a--

Col. 12, Claim 16, Line 37:
ADD after d. --a--

Signed and Sealed this
Seventeenth Day of April, 2012

David J. Kappos
*Director of the United States Patent and Trademark Office*